US008064799B2

(12) United States Patent
Tanaka et al.

(10) Patent No.: US 8,064,799 B2
(45) Date of Patent: Nov. 22, 2011

(54) ELECTROPHOTOGRAPHIC IMAGE FORMING APPARATUS WITH LIGHT SOURCE TO ELECTRICALLY DISCHARGE CHARGE REMAINING ON DRUM

(75) Inventors: Noriaki Tanaka, Suntou-gun (JP); Tsuyoshi Otake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 12/568,052

(22) Filed: Sep. 28, 2009

(65) Prior Publication Data

US 2010/0080623 A1 Apr. 1, 2010

(30) Foreign Application Priority Data

Sep. 29, 2008 (JP) ..... 2008-249589
Aug. 19, 2009 (JP) ..... 2009-189701
Sep. 7, 2009 (JP) ..... 2009-205488

(51) Int. Cl.
*G03G 21/00* (2006.01)
*G03G 15/00* (2006.01)

(52) U.S. Cl. ..... 399/128; 399/110; 399/118

(58) Field of Classification Search ..... 399/110, 399/111, 114, 118, 128
See application file for complete search history.

(56) References Cited

U.S. PATENT DOCUMENTS 6,678,491 B2 * 1/2004 Ino et al. ..... 399/128
6,708,011 B2 * 3/2004 Nomura et al. ..... 399/110
2002/0039497 A1 * 4/2002 Yasuda et al. ..... 399/89
2006/0067734 A1 * 3/2006 Igarashi et al. ..... 399/119
2008/0193163 A1 * 8/2008 Moon et al. ..... 399/128

FOREIGN PATENT DOCUMENTS

JP 2006-276529 * 10/2006
JP 2007-034086 2/2007

* cited by examiner

*Primary Examiner* — Sandra Brase
(74) *Attorney, Agent, or Firm* — Fitzpatrick, Cella, Harper & Scinto

(57) ABSTRACT

An electrophotographic image forming apparatus includes a cartridge supporting member movable between an inside position inside the main assembly of the apparatus and an outside position outside the main assembly, a light source, a light guide member, on the cartridge supporting member, for guiding the light from the light source to electrically discharge charge remaining on a drum after a developed image on the drum is transferred onto recording material when the cartridge is in an image forming position, an interrelating member for moving the light source to an operating position where the light enters the light guide member in interrelation with movement of the cartridge supporting member from the outside to the inside positions, and a positioning member positioning the light source at the operating position.

7 Claims, 19 Drawing Sheets

(a)

(b)

(a)

(b)

(a)

(b)

ELECTROPHOTOGRAPHIC IMAGE FORMING APPARATUS WITH LIGHT SOURCE TO ELECTRICALLY DISCHARGE CHARGE REMAINING ON DRUM

FIELD OF THE INVENTION AND RELATED ART

The present invention relates to an electrophotographic image forming apparatus.

Here, an "electrophotographic image forming apparatus" means an apparatus which forms an image on recording medium with the use of an electrophotographic image forming method. Examples of electrophotographic image forming apparatus include an electrophotographic copying machine, an electrophotographic printer (laser beam printer, LED printer, for example, a facsimile apparatus, a wordprocessor, and so on.

A "process cartridge" means a cartridge in which an electrophotographic photosensitive drum (which hereafter will be referred to as photosensitive drum), and one or more processing means for processing the photosensitive drum, are integrally disposed, and which is removably mountable in the main assembly of an electrophotographic image forming apparatus. The processing means are such means as a developing means (developing member), a charging means (charging member), and a cleaning means (cleaning member), that are for processing the photosensitive drum. Thus, a process cartridge is a cartridge which integrally holds a photosensitive drum, and at least one among a developing means, a charging means, and a cleaning means, so that the processing means can be removably mounted in the main assembly of an electrophotographic image forming apparatus.

A process cartridge is removably mountable in the main assembly of an electrophotographic image forming apparatus by a user himself or herself. Therefore, the employment of a process cartridge makes it easier to maintain the apparatus.

In the field of an electrophotographic image forming apparatus, those in which one or more process cartridges, such as those described above, are removably mountable are widely used. In the case of those electrophotographic image forming apparatuses, as a process cartridge is mounted into the main assembly of any of the apparatuses, the driving force transmitting member of the apparatus becomes connected to the driving portion of the process cartridge so that the driving force from the main assembly of the image forming apparatus is transmitted to the process cartridge to rotate the photosensitive member in the cartridge, or the like, to form an image.

The photosensitive drum which the process cartridge has is subjected to a pre-exposure process before it is subjected to a charging process. The pre-exposure process is for completely removing electric charge from the photosensitive drum to prevent the photosensitive drum from being unevenly charged. Thus, it has been known that some image forming apparatuses are provided with a light guiding member, which is used for the pre-exposure process (Japanese Laid-open Patent Application 2007-034086).

SUMMARY OF THE INVENTION

However, the above described prior art was unsuccessful in satisfactorily attaching a light guiding member to the cartridge supporting member of an electrophotographic image forming apparatus, which is moved between its preset inward position (position in main assembly of apparatus) and its preset outward position (position outside main assembly of apparatus) while removably supporting the cartridges.

The primary object of the present invention is to provide an electrophotographic image forming apparatus having a light guiding member on a cartridge supporting member which moves between the abovementioned inward and outward positions.

Another object of the present invention is to provide an electrophotographic image forming apparatus which is significantly superior to conventional image forming apparatuses in the level of accuracy with which its light guiding member and light source are positioned relative to each other, even though the light guiding member is attached to the cartridge supporting member of the apparatus.

According to an aspect of the present invention, there is provided an electrophotographic image forming apparatus for forming an image on a recording material in the state that cartridge is detachably mounted to a main assembly of said electrophotographic image forming apparatus, said electrophotographic image forming apparatus comprising a cartridge supporting member movable between an inside position in said main assembly of the apparatus and an outside position which is outside said main assembly of the apparatus and in which said cartridge is mountable and the mountable, in the state that cartridge is detachably mounted thereon; a light source for emitting light; a light guide member, provided on said cartridge supporting member, for guiding the light emitted from said light source along a longitudinal direction of said electrophotographic photosensitive drum to electrically discharge charge remaining on said electrophotographic photosensitive drum after a developed image formed on said electrophotographic photosensitive drum is transferred onto the recording material in the state that cartridge is in an image forming position, which is the inside position, for forming the image on the recording material; and an interrelating member for moving said light source to an operating position where the light emitted from said light source enters said light guide member in interrelation with movement of said cartridge supporting member from the outside position to the inside position; a positioning member for positioning said light source at the operating position relative to said light guide member provided on said cartridge supporting member positioned in the inside position.

The present invention makes it possible to provide an electrophotographic image forming apparatus having a light guiding member attached to the cartridge supporting member of the main assembly of the apparatus, which moves between the inward position in the main assembly and the outward position outside the main assembly while removably supporting cartridges.

The present invention makes it possible to provide an electrophotographic image forming apparatus which is significantly superior to conventional image forming apparatuses in the level of accuracy with which its light guiding member and light source are positioned relative to each other, even though the light guiding member is attached to the cartridge supporting member of the apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the electrophotographic image forming apparatus (which hereafter will be referred to simply as "image forming apparatus") in accordance with the present invention will be concretely described with reference to the appended drawings.

Embodiment 1

(Overall Structure of Image Forming Apparatus)

Figure 1A:
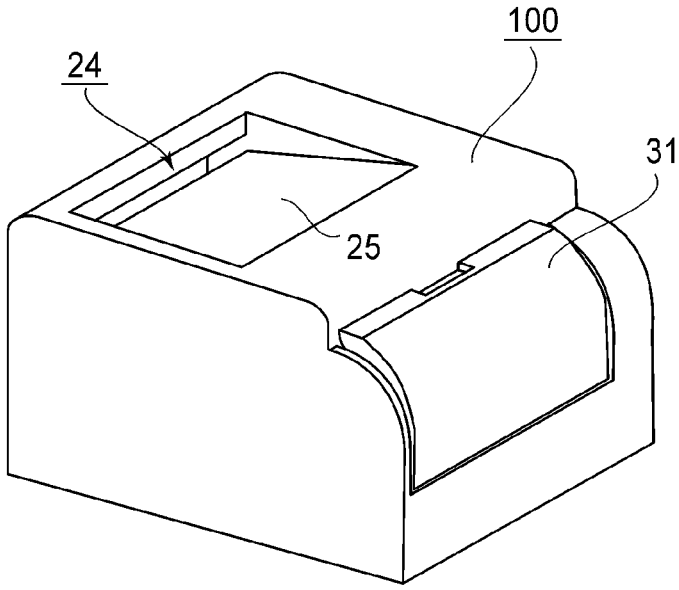
FIG. 1A is a perspective external view of the image forming apparatus in the first preferred embodiment of the present invention.
Figure 1B:
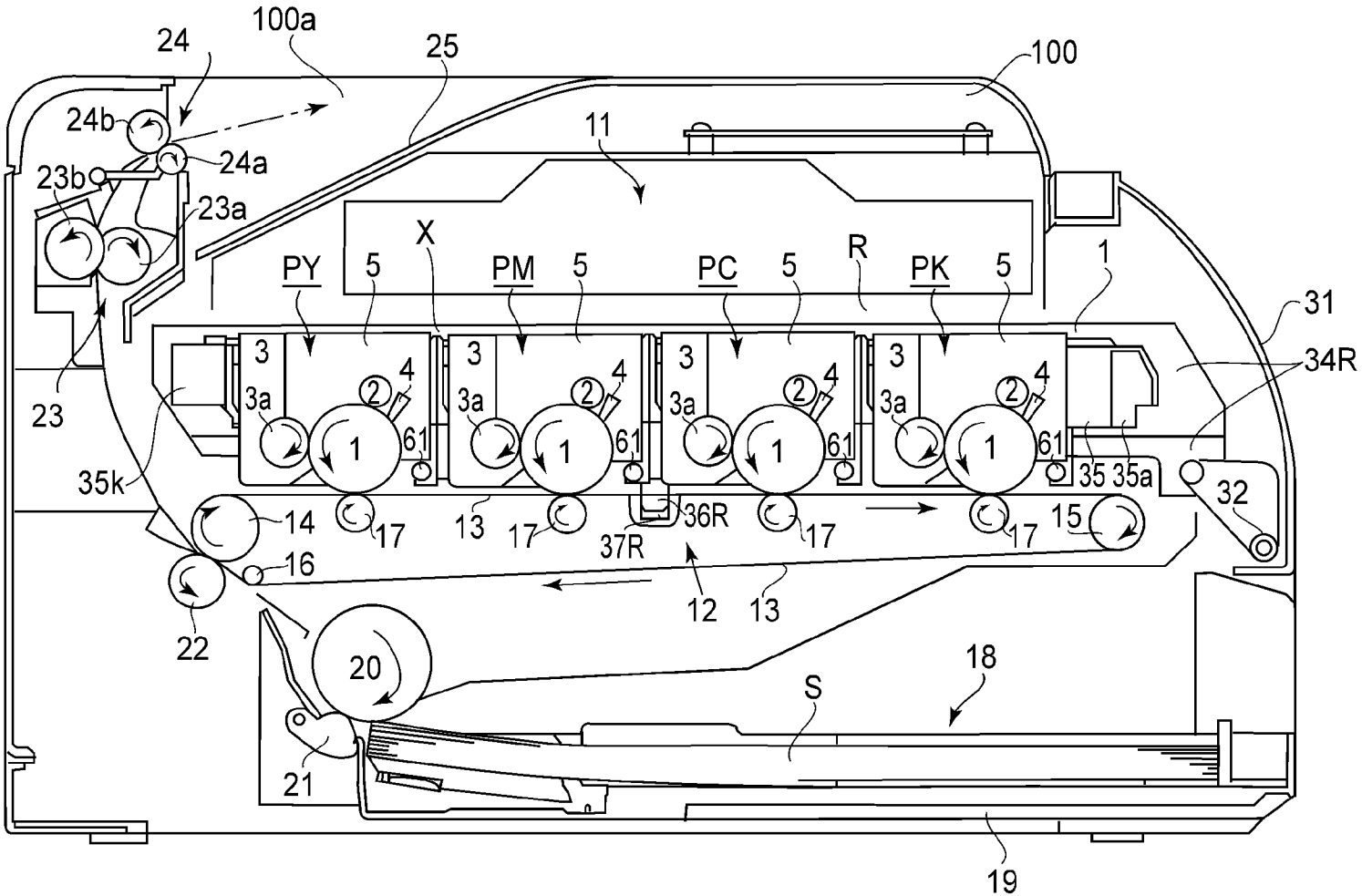
FIG. 1B is a vertical sectional view of the image forming apparatus, as seen from the left side of the apparatus.
Figure 2:
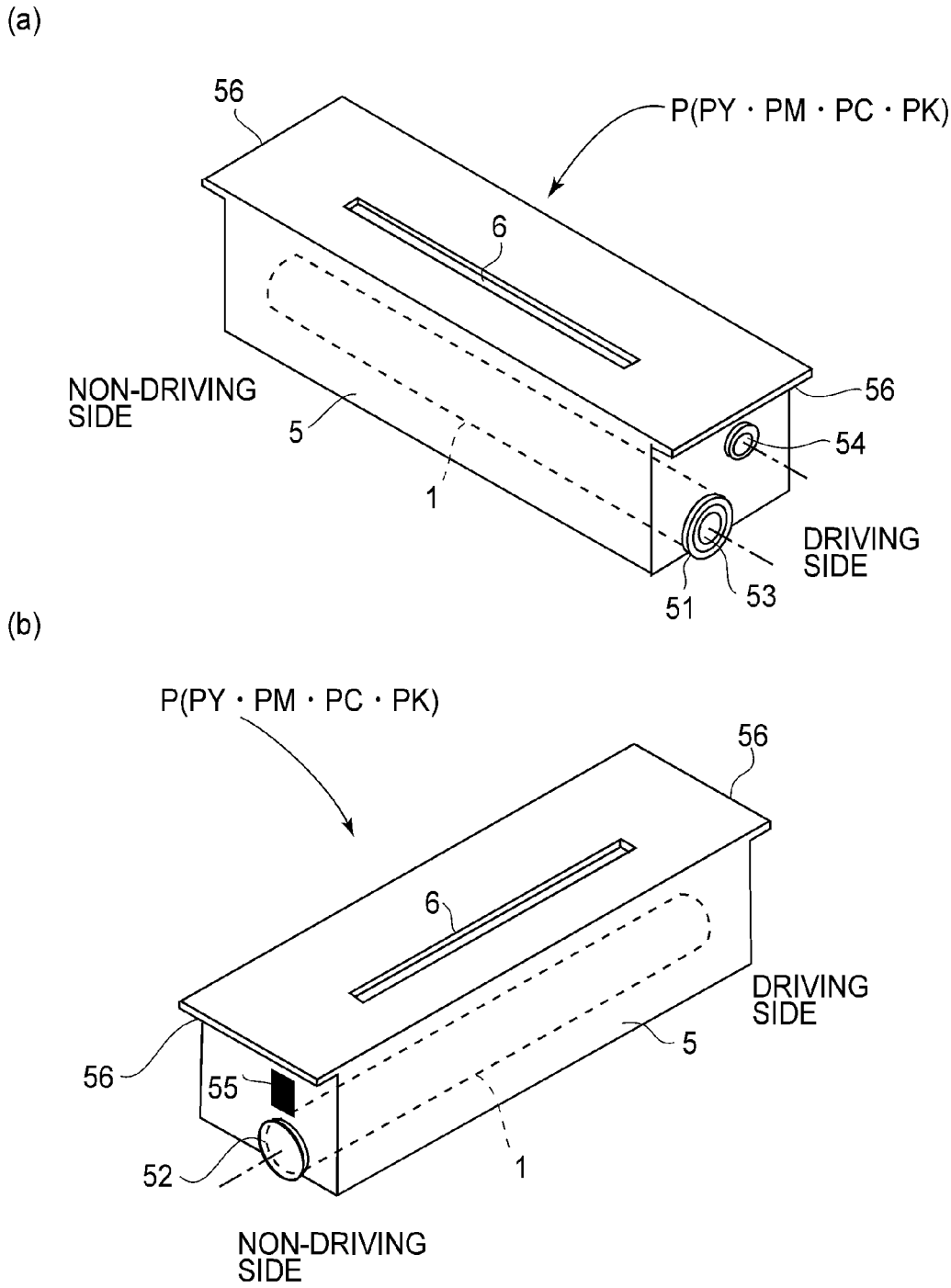
FIG. 2 is a perspective external view (a) of the cartridge in the first embodiment, as seen from the side from which the cartridge is driven, and a perspective external view (b) of the same cartridge as the one in FIG. 2(*a*), as seen from the side from which the cartridge is not driven.

First, referring to FIG. 1(*a*)-FIG. 2(*b*), the overall structure of the image forming apparatus in the first preferred embodiment of the present invention will be described. FIG. 1A is a perspective external view of the image forming apparatus, and FIG. 1B is a sectional view of the image forming apparatus. FIGS. 2(*a*) and 2(*b*) are perspective views of the process cartridge.

The electrophotographic image forming apparatus 100 in this embodiment of the present invention is a full-color laser printer, which uses an electrophotographic image formation process and four primary colors. The image forming apparatus 100 forms an image on recording medium, in response to the image formation signals inputted from an external host apparatus, for example, a personal computer, an image reader, a facsimile apparatus (from which image is sent), and the like. Here, recording medium means any medium, for example, paper, OHP sheet, label, etc., on which an image can be formed with the use of an electrophotographic image formation process. The image forming apparatus 100 forms an image on a sheet S of recording medium with the use of cartridges (P), which remain removably mounted in the main assembly 100*a* of the image forming apparatus (which hereafter will be referred to simply as "main assembly 100*a*") while an image is formed.

In the following descriptions of the preferred embodiments of the present invention, the front side of the image forming apparatus means the side where a door 31 (which can be opened or closed) is present, and the rear side of the image forming apparatus means the side opposite from the front side. Further, the left or right side of the image forming apparatus means the left or right side when the main assembly 100*a* is seen from the front side.

Referring to FIG. 1B, the main assembly 100*a* contains four process cartridges P (which hereafter will be referred to simply as "cartridge P"), more specifically, first to fourth cartridges PY, PM, PC, and PK (listing from front side), respectively, which were horizontally mounted in parallel in the main assembly 100*a*. The four cartridges P are the same in structure, although they are different from each other in the color of the toner they contain.

Each of the cartridges P in this embodiment is made up of an electrophotographic photosensitive drum 1, three processing means, and a cartridge frame 5 (FIG. 2). The electrophotographic photosensitive drum (which hereafter will be referred to simply as "photosensitive drum 1") is the first image bearing member. Three processing means are a charging member 2, a developing device 3, and a cleaning member 4. The photosensitive drum 1 and the three processing means are integrally attached to the inward side of the cartridge frame 5.

The charging member 2 is of the contact type. The developing device 3 has a development roller 3*a*. The developer container portion of the developing device 3 contains developer (toner). The cleaning member 4 is in the form of a blade.

The first cartridge PY contains yellow (Y) toner in its developing device 3, and forms a yellow toner image (image formed of yellow toner) on its drum 1. The second cartridge PM contains magenta (M) toner in its developing device 3, and forms a magenta toner image (image formed of magenta toner) on its drum 1. The third cartridge PC contains cyan (C) toner in its developing device 3, and forms a cyan toner image (image formed of cyan toner) on the drum 1. The fourth cartridge PK contains black (K) toner, and forms a black toner image (image formed of black toner) on its drum 1.

Next, referring to FIG. 2(*a*), one of the lengthwise ends of the cartridge P is provided with a drum coupling 53 and a development roller coupling 54, which are for transmitting driving force to the photosensitive drum 1 and development roller 3*a*, respectively. Also referring to FIG. 2(*b*), the other lengthwise end of the cartridge P is provided with an electrical contact 55.

The main assembly 100*a* is provided with a laser scanner unit 11, which is above the cartridges PY, PM, PC, and PK. The unit 11 scans (exposes) the peripheral surface of the photosensitive drum 1 of each cartridge P through an exposure window 6 (FIGS. 2(*a*) and 2(*b*)) with which the top wall of the cartridge frame 5 is provided, by outputting a beam of laser light while modulating the beam of laser light with the information regarding each of the monochromatic images, which is inputted from the external host apparatus.

The main assembly 100*a* is also provided with an intermediary transfer belt unit 12, which is below the cartridges PY, PM, PC, and PK. The unit 12 has an endless belt 13, a driver roller 14, a tension roller 15, and an auxiliary roller 16. The endless belt 13 is an intermediary transfer member (image bearing second member) formed of a dielectric material. The rollers 14, 15, and 16 are the rollers by which the belt 13 is kept stretched and is circularly driven. The driver roller 14 and auxiliary roller 16 are on the rear side of the internal space of the main assembly 100*a*. The roller 15 is on the front side of the internal space of the main assembly 100*a*.

The drum 1 which each cartridge P has is in contact with the belt 13 in such a manner that the bottom portion of the peripheral surface of the drum 1 is in contact with the top surface of the top side of the transfer belt loop. The main assembly 100*a* is provided with four primary transfer rollers 17, which are disposed within the transfer belt loop. The four primary transfer rollers 17 are positioned so that they oppose the four drums 1 of the four cartridges P, one for one, with the presence of the top portion of the belt 13 between the four transfer rollers 17 and four drums 1, one for one. Further, the main assembly 100*a* is provided with a secondary transfer roller 22, which is kept pressed against the driver roller 14, with the presence of the belt 13 between the two rollers 22 and 14.

The unit 12 is provided with a recording medium feeder unit 18, which is in the bottom portion of the unit 12. The recording medium feeder unit 18 has a tray 19, a roller 20, a separation pad 21, etc. The tray 19 is removably mountable in the main assembly 100*a* from the front side of the main assembly 100*a* (front loading).

Further, the main assembly 100*a* is provided with a fixing apparatus 23 and a pair of discharge rollers 24, which are in the top rear portion of the main assembly 100*a*. A part of the top wall of the main assembly 100*a* is in the form of a tray 25. The fixing apparatus 23 used in this embodiment has a fixation film assembly 23*a* and a pressure roller 23*b*. The discharge roller pair 24 is made up of a roller 24*a* and a roller 24*b*.

When each of the cartridges P is in its preset image formation position in the main assembly 100*a*, the driving force output portion of the main assembly 100*a* is in connection with the driving force input portion of the cartridge P; the electrical contacts of each cartridge P are electrically in contact with the electrical power supplying system of the main assembly 100*a*.

In an image forming operation, four toner images (images formed of developer) are formed on the four photosensitive drums 1, one for one, with the use of an electrophotographic image forming method. Then, the four toner images are sequentially transferred (primary transfer) onto the rotating belt 13. As a result, a full-color image is effected on the belt 13. In synchronism with the progression of this image forming operation, a sheet S (of recording medium) is conveyed into the secondary transfer portion, which is between the secondary transfer roller 22 and belt 13, while a bias is applied to the transfer roller 22. As a result, the toner images on the belt 13 are transferred together onto the sheet S by the bias.

Further, after the transfer of the toner images onto the sheet S, the sheet S is conveyed to the fixation apparatus 23, in which the sheet S is subjected to heat and pressure to fix the toner images to the sheet S. After the fixation of the toner images, the sheet S is discharged from the fixing apparatus 23 by the pair of discharge rollers 24.

(Structural Arrangement for Mounting or Dismounting Cartridge)

Next, referring to FIGS. 3-5(*b*), the structural arrangement for mounting the cartridges P (PY, PM, PC, and PK) into the main assembly 100*a*, or dismounting the cartridges P (PY, PM, PC, and PK) from the main assembly 100*a*, will be described.

Figure 3:
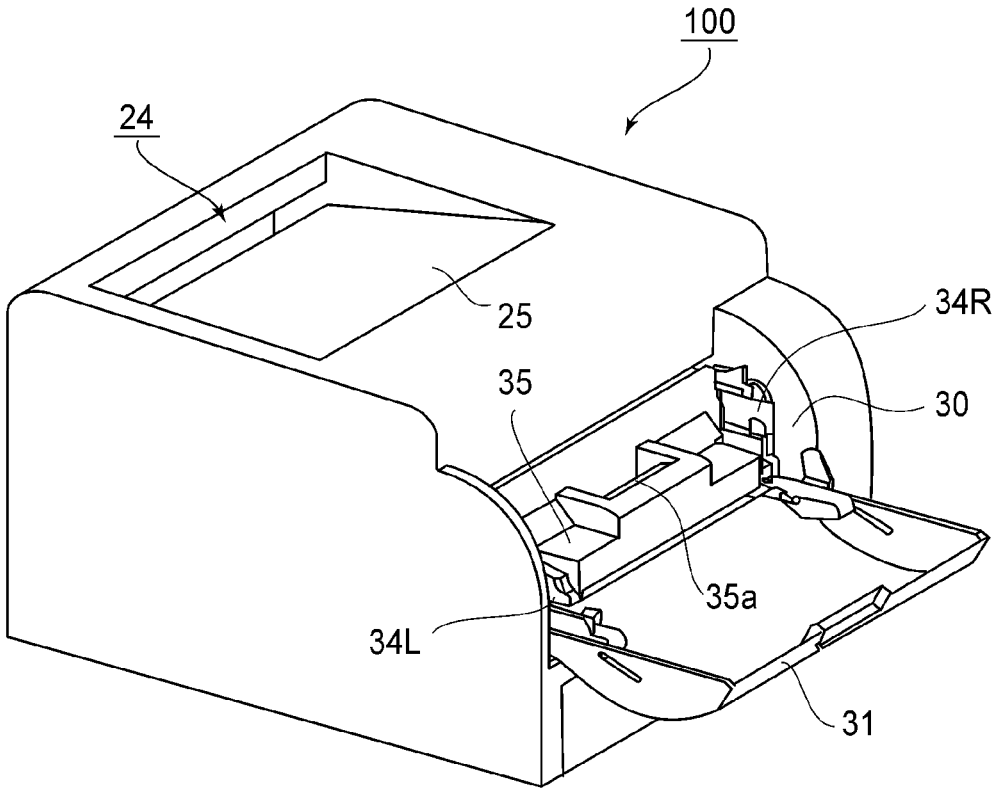
FIG. 3 is a perspective external view of the image forming apparatus in the first preferred embodiment, with its door open.
Figure 4A:
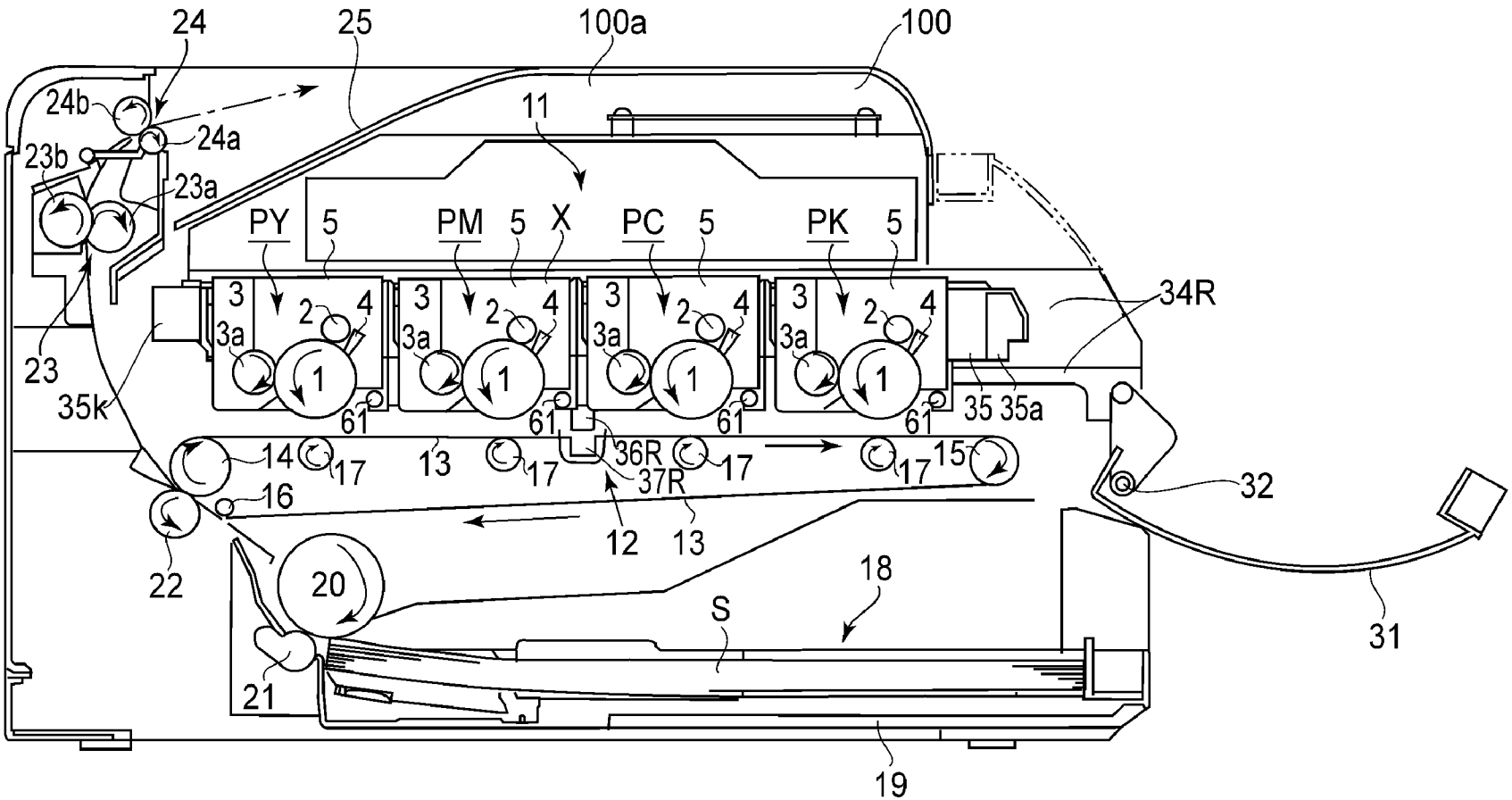
FIG. 4A is a vertical sectional view of the image forming apparatus in the first preferred embodiment, as seen from the left side of the apparatus, with its door open.

Referring to FIGS. 3 and 4(*a*), the front panel of the main assembly 100*a* is provided with a hole 30, through which a drawer 35 (cartridge supporting member) is moved into, or out of, the main assembly 100*a*. Further, the front panel is provided with a door (which can be opened or closed), which can be opened to expose the hole 30, or closed to cover the hole 30. The door 31 is attached to the front panel so that it can be rotationally moved about a shaft 32; it can be moved into the position in which it keeps the hole 30 covered, and the position in which it keeps the hole 30 fully exposed.

The main assembly 100*a* is provided with a cartridge space X in which the cartridges are mounted. The cartridge space X is in the main assembly 100*a*. The aforementioned cartridge drawer 35, which supports the cartridges P, is attached to the main assembly 100*a* so that the cartridge drawer 35 can be moved into, or out of, this space X. More specifically, referring to FIG. 3, the cartridge drawer 35 is attached to the main assembly frame in such a manner that it is slidingly movable in the frontward or backward direction while being guided by a pair of rails 34L and 34R with which the left and right internal walls, respectively, of the main assembly frame, which form the space X. Thus, the cartridge drawer 35 is movable between its inward position I (FIG. 1B) and outward position O (FIG. 5A). The inward position I is the position, in which the cartridge drawer 35 accurately positions the cartridges P in the image formation positions R, one for one, in which the cartridges P contribute to image formation. The outward position O is the position in which the cartridge drawer 35 places the four cartridges P outside the main assembly 100*a*. It is when the cartridge drawer 35 is in the outward position that a user can replace (mount or dismount) the cartridges P in the cartridge drawer 35 (which hereafter may be referred to simply as tray 35). That is, it is into, or from, the tray 35 that a user mounts (supports) or removes the cartridge(s) P.

Further, as the cartridge drawer 35 is moved into the main assembly 100*a*, it is accurately positioned relative to the main assembly 100*a* by its cartridge drawer positioning portion 36R of the tray 35, and the cartridge drawer positioning portion 37R of the main assembly 100*a*.

The cartridge drawer 35 is provided with multiple cartridge supporting portions 35*i* for supporting the cartridges PY, PM, PC, and PK, one for one. Thus, the cartridges P are fitted into the cartridge supporting portions 35*i*, one for one. As the four cartridges P are fitted into the cartridge supporting portions 35*i*, they become, and remain, immovable relative to the cartridge drawer 35. Next, referring to FIG. 3, the cartridge drawer 35 is provided with a handle 35*a*, which is attached to the front panel of the cartridge drawer 35. The handle 35*a* becomes exposed as the door 31 is opened.

Figure 4B:
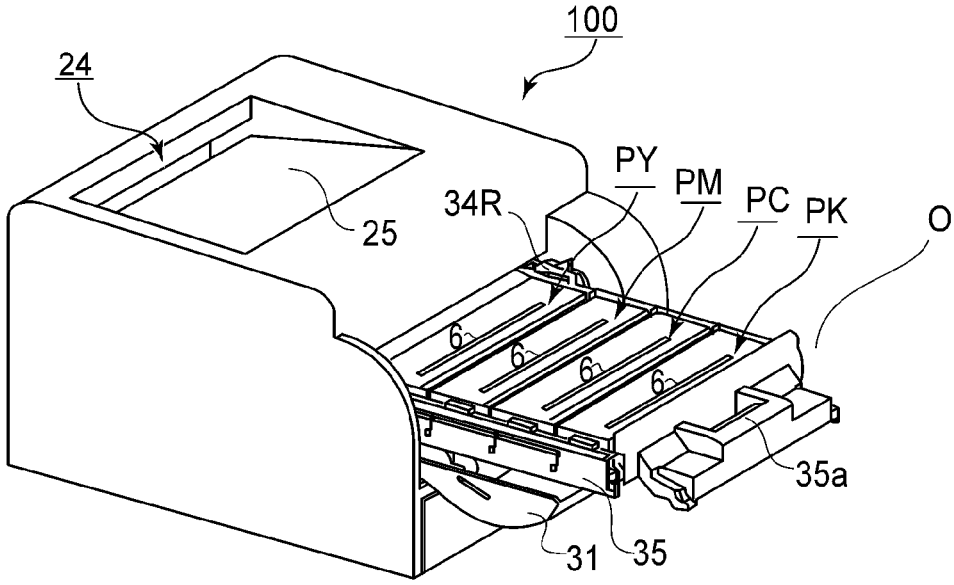
FIG. 4B is an external perspective view of the image forming apparatus in the first preferred embodiment, when the tray of the apparatus is outside the apparatus.

The procedure for mounting or dismounting the cartridges P is as follows. First, the door 31 is to be opened, and then, the handle 35*a* is to be grasped. Then, the cartridge drawer 35 is to be pulled out frontward of the main assembly 100*a* to the preset position (cartridge mounting or dismounting position) so that the cartridges PY, PM, PC, and PK are exposed while remaining supported by the cartridge drawer 35, as shown in FIG. 4B, making it possible for any of the cartridges P to be upwardly moved out of the cartridge drawer 35, as shown in FIG. 5A. Therefore, the cartridges P can be easily replaced. As described above, the image forming apparatus 100 in this embodiment is structured to allow the cartridge drawer 35 to be slidingly moved into, or out of, the main assembly 100*a* so that the multiple cartridges P can be easily mounted into, or dismounted from, the main assembly 100*a*.

Figure 5B:
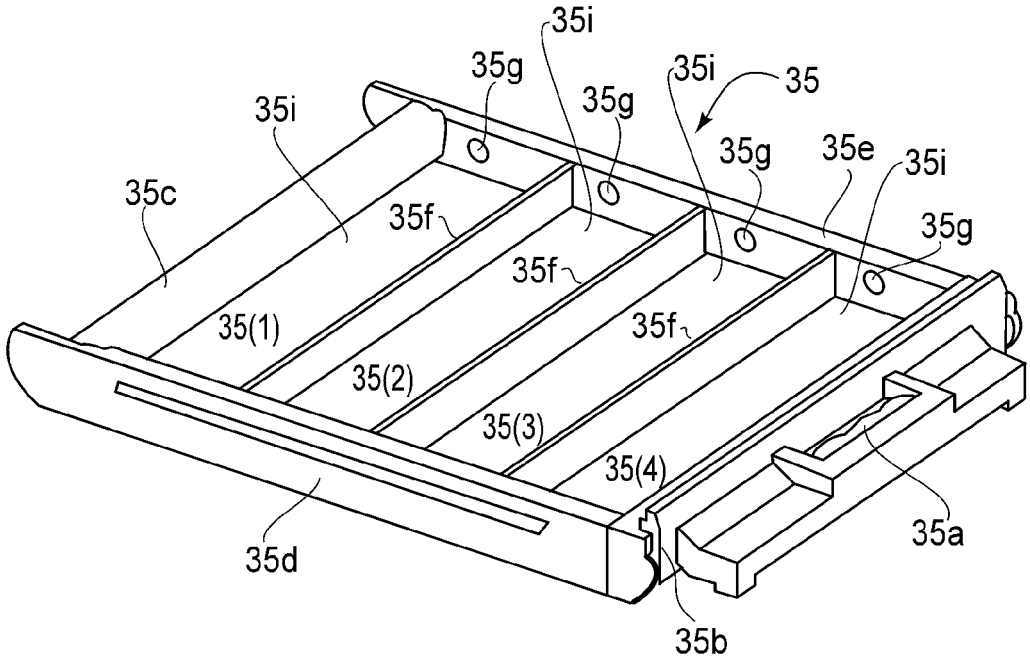
FIG. 5B is a perspective view of the tray of the apparatus.
Figure 5A:
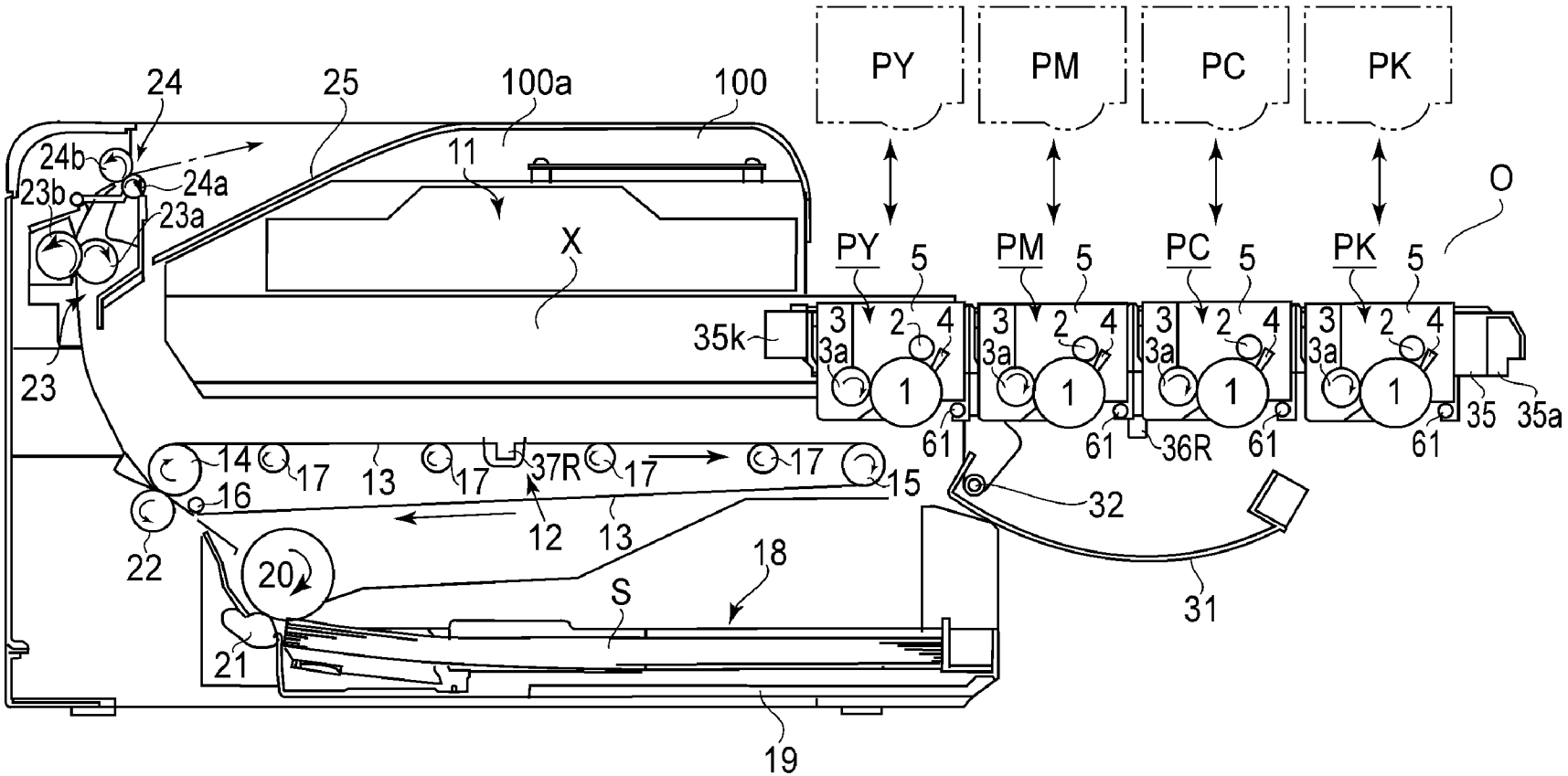
FIG. 5A is a vertical sectional view of the image forming apparatus in the first preferred embodiment, the tray of which is outside the main assembly.

FIG. 5B is a perspective external view of the cartridge drawer 35 (cartridge supporting member). The tray 35 has a rectangular primary frame. The internal space of the primary frame is evenly divided by three partitioning plates 35*f* in terms of the front-to-rear direction, providing thereby four sub-spaces which are roughly even in size. Hereafter, these four sub-spaces will be referred to as the first to fourth cartridge chambers 35(1)-35(4), that is, the chambers in which the first to fourth cartridges PY, PM, PC, and PK are supported, respectively, listing from the rear section 35c of the primary frame to the front section 35*b* of the primary frame. The right section 35*e*, which makes up the right frame of each of the cartridge chambers 35(*a*) 35(*f*) 35(1)-35(4) is provided with a hole 35*g*, through which a development roller driving coupler is put into, or moved out of, the cartridge chamber 35 (1, 2, 3, or 4).

Each cartridge P is inserted into its designated cartridge chamber of the cartridge drawer 35 from above the drawer 35. As the cartridge P is mounted into the cartridge drawer 35, the left and right eave-like portions 56 of the top wall of the cartridge P are caught by the left and right sections 35*d* and 35*e* of the primary frame; the bottom surface of the eave-like portion 56 is caught by the top surface of the section 35*d* (or 35*e*) of the primary frame. Thus, the cartridges P are supported by the tray 35 in a manner of riding on the tray 35. In other words, the cartridge drawer 35 supports the cartridges P in such a manner that the cartridges P can be upwardly taken out of the cartridge drawer 35, and that the cartridges P can be supported by the cartridge drawer 35 by vertically and downwardly moving the cartridges P from directly above the cartridge drawer 35.

A user is to mount the cartridge(s) P into the cartridge drawer 35 after pulling the cartridge drawer 35 out of the main assembly 100*a*, and then, to push the cartridge drawer 35 into the main assembly 100*a* by sliding the cartridge drawer 35 toward the rear portion of the main assembly 100*a*. As the cartridge drawer 35 is pushed into the preset cartridge drawer position, from which the cartridge drawer 35 is vertically moved, a protrusion 35*k*, which protrudes from the inward end of the cartridge drawer 35 comes into contact with the tray positioning portion of the main assembly 100*a*. Then, the user is to close the door 31. As the user closes the door 31, the rails 34 move downward, and the cartridge drawer 35 is accurately position relative to the main assembly 100*a* by the cartridge drawer positioning portions 37R of the drawer 35, and the cartridge positioning portion 37R of the main assembly 100*a*. The door 31 is to be closed further after the positioning of the cartridge drawer 35. As the door 31 is closed further, the drum coupling 53 and development roller coupling 54 of each cartridge P engage with the corresponding driving force transmission couplings of the main assembly 100*a*, and each cartridge P is immovably positioned in its image formation position R.

(Light Guiding Member for Pre-Exposure)

The photosensitive drum 1 of the image forming apparatus in this embodiment is pre-exposed; it is exposed before it is charged for image formation by the charging member 2. The electric charge remaining on the photosensitive drum 1 is removed by this pre-exposure. That is, the photosensitive drum 1 is exposed (this exposure may be referred to simply as "pre-exposure") before it is charged by the charging member 2 for image formation. In order to pre-expose the photosensitive drum 1, light is guided by a light guide 61 (light guiding member) from the light source, with which the main assembly 100*a* is provided, to the photosensitive drum 1. In this embodiment, it is the cartridge drawer 35 that is provided with the light guide 61.

Figure 6:
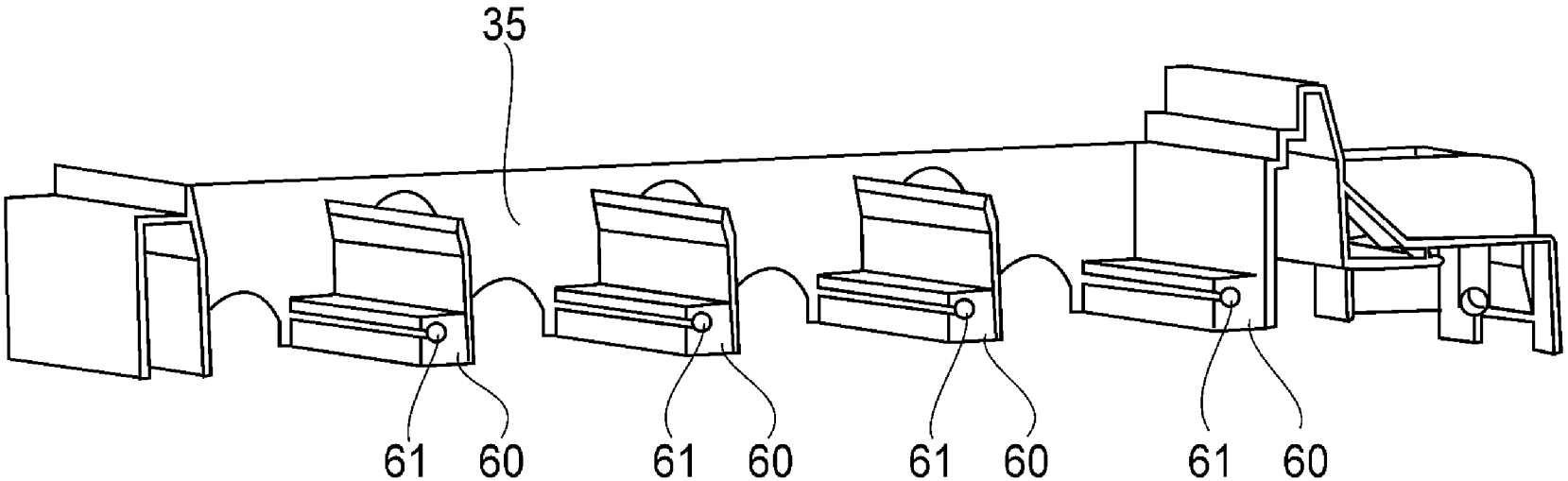
FIG. 6 is a perspective view of the tray, in the first preferred embodiment, which has the pre-exposure light guiding members.
Figure 7:
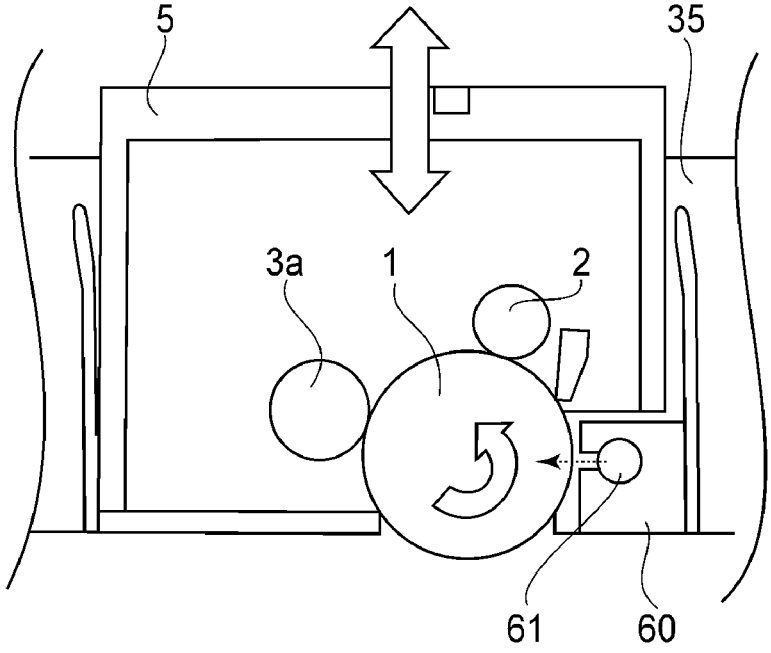
FIG. 7 is a drawing (a) for describing the relationship between the light guide and photosensitive drum, and a drawing (b) for describing the relationship between the light guide and cartridge, in terms of their mechanical engagement.
Figure 7:
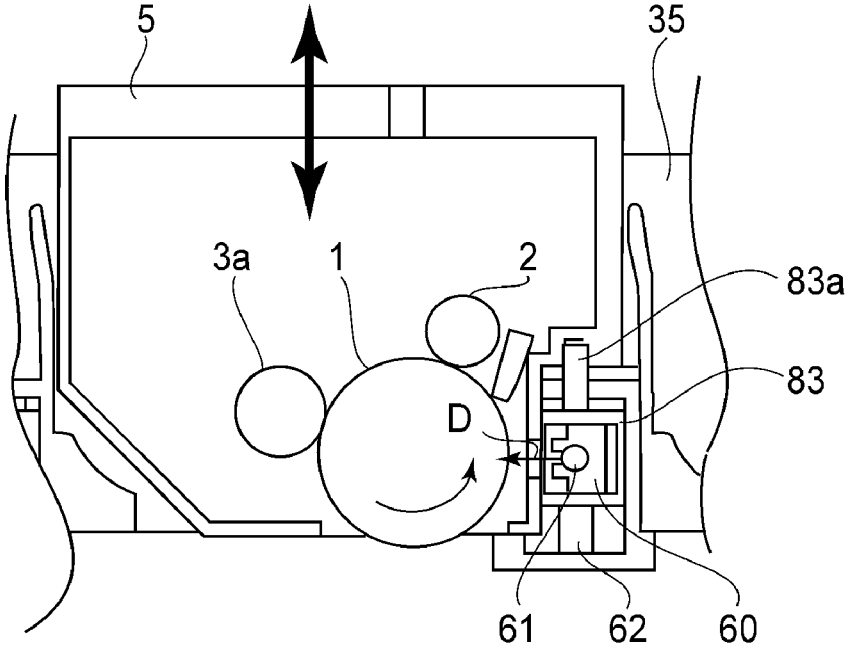

FIG. 6 shows the pre-exposure light guides 61 attached to the cartridge drawer 35, and FIG. 7(*a*) shows the relationship between one of the light guides 61, and the internal components of the cartridge P, which are related to the light guides 61.

The light guide 61 (light guiding member) is formed of transparent acrylic. It is for projecting charge removal light upon the peripheral surface of the photosensitive drum 1 in the direction indicated by an arrow mark D. The charge removal light is a narrow band of light, which is uniform in intensity in terms of the widthwise direction of the photosensitive member. In order to prevent the charge removal light from leaking from the light guide 61, the light guide is covered with a light guide housing 60. Incidentally, the light guide 61 and its housing 60 may be formed as integral parts of the cartridge drawer 35, or as physically independent components from the cartridge drawer 35.

Further, the image forming apparatus 100 may be structured so that the light guide 61 is accurately positioned relative to the photosensitive drum 1 in the cartridge P by the light guiding member positioning means, after the mounting of the cartridge P. In such a case, the main assembly 100*a* is provided with a slidingly movable member 83, to which the housing 60 and light guide 61 are attached, and the main assembly 100*a* is structured so that the mounting of the process cartridge P causes the slidingly movable member 83 to move into the position in which the light guide 61 opposes the photosensitive drum 1 as shown in FIG. 7(*b*), for example.

Figure 8:
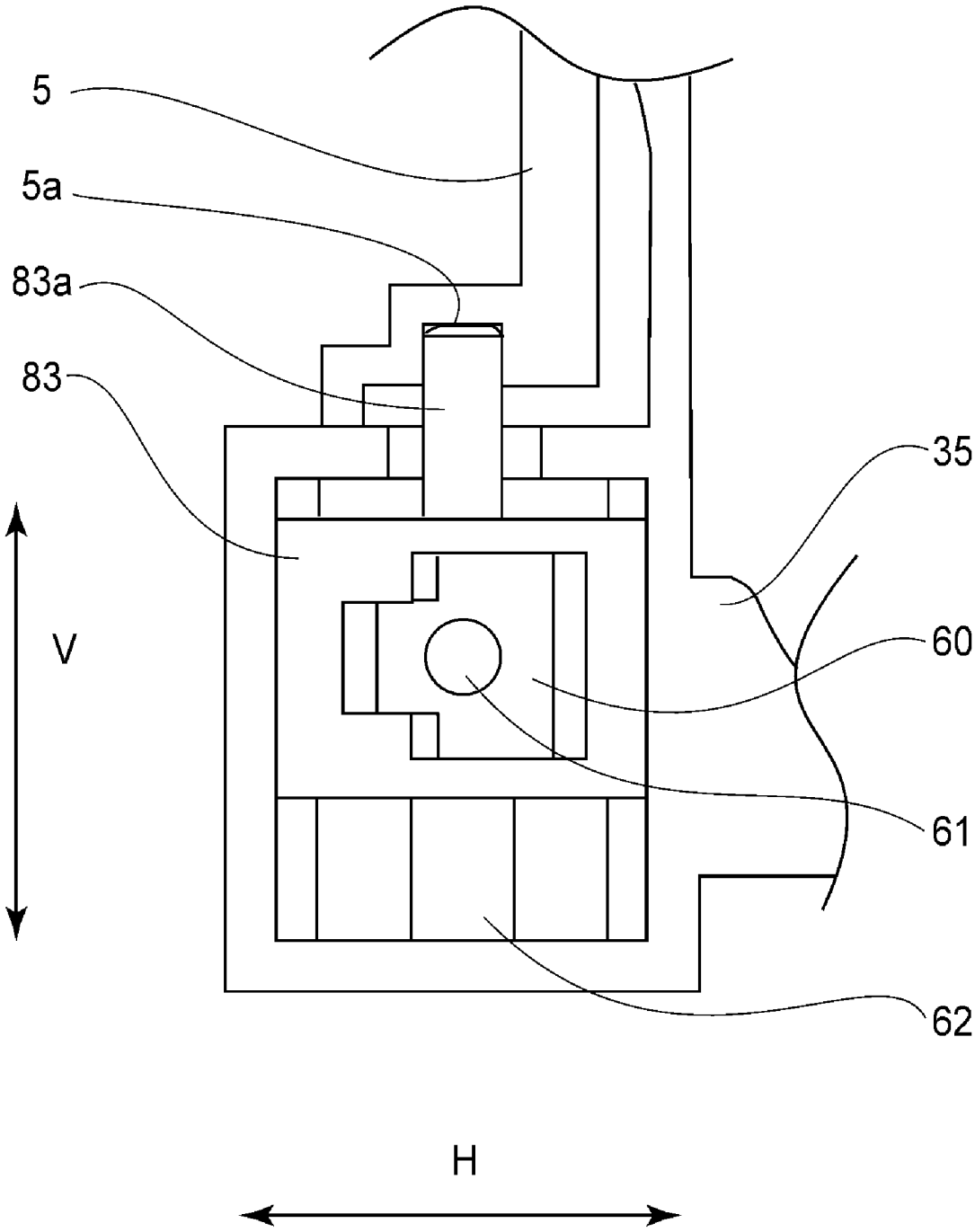
FIG. 8 is a sectional view of the structural arrangement for accurately positioning the light guide.
Figure 9:
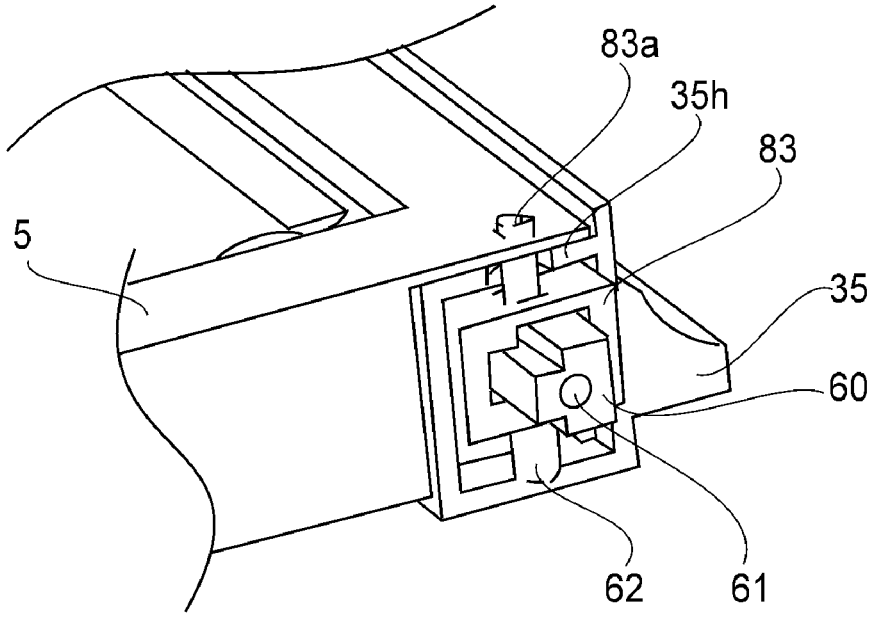
FIG. 9 is a perspective view (a) of the structural arrangement for accurately positioning the light guide, and is a plan (b) of the projection of the light guide and the recess of the cartridge frame.
Figure 9:
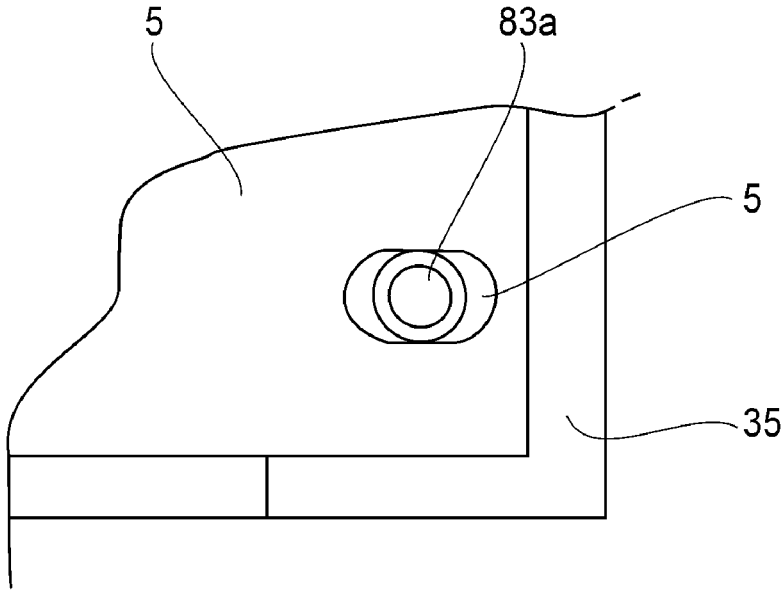

More concretely, referring to FIGS. 8 and 9(*a*), the slidingly movable member 83 which holds the housing 60 and light guide 61 is attached to the main assembly 100*a* so that the slidingly movable member 83 can be vertically (direction indicated by referential letter V) moved relative to the cartridge drawer 35. Further, the slidingly movable member 83 is provided with a spring 62 (elastic member) which is attached to the bottom of the slidingly movable member 83 so that the slidingly movable member 83 remains upwardly pressured by the resiliency of the spring 62. The slidingly movable member 83, which is under the upward pressure from the spring 62, remains in contact with a stopper 35*h* (FIG. 9(*a*)), with which the cartridge drawer 35 is provided. Further, the slidingly movable member 83 is provided with an upward projection 83*a* (cartridge contacting member), with which the cartridges P come into contact as the cartridges P are mounted into the cartridge drawer 35. The projection 83*a* remains pressured by the resiliency of the spring 62 in the direction to come into contact with the cartridge P. As described above, the light guide 61 is attached to the slidingly movable member 83 which is movably attached to the cartridge drawer 35. Further, the slidingly movable member 83 has the projection 83*a* which comes into contact with the cartridge P. Moreover, the slidingly movable member 83 is provided with the spring 62 which keeps the cartridge P pressured so that the projection 83*a* remains in contact with the cartridge P.

Next, referring to FIG. 8, the housing 60 is attached to the slidingly movable member 83 in such a manner that it is not allowed to move in the direction indicated by the arrow mark V, but, is allowed to move in the direction indicated by an arrow mark H within a preset range.

Also referring to FIG. 8, as the cartridge P is mounted into the cartridge drawer 35, the projection 83*a* comes into contact with the cartridge frame 5; the projection 83*a* fits into a recess 5*a* of the cartridge frame 5. Then, the slidingly movable member 83 is pushed down by the cartridge frame 5 against the resiliency of the spring 62.

It is possible that as the photosensitive drum 1 begins to be driven for image formation, the frame 5 will move. Therefore, the recess 5*a* is shaped so that in terms of its cross section, its long edges are parallel to the moving direction of the frame 5 as shown in FIG. 9(*b*). Further, the image forming apparatus 100 is structured so that the frame 5 is allowed to move while the projection 83*a* is in contact with the lateral wall of the recess 5*a*.

The light guide 61 is accurately position relative to the cartridge P, as described above, whereby the photosensitive drum 1 and light guide 61 are more accurately position relative to each other than they are conventionally.

Further, the image forming apparatus 100 in this embodiment is provided with a light source positioning member for accurately positioning the pre-exposure LED 80 (pre-exposure light source) relative to the light guide 61 when the cartridge drawer 35 is moved into its image formation position. The LED 80 emits the light for pre-exposure.

Figure 10:
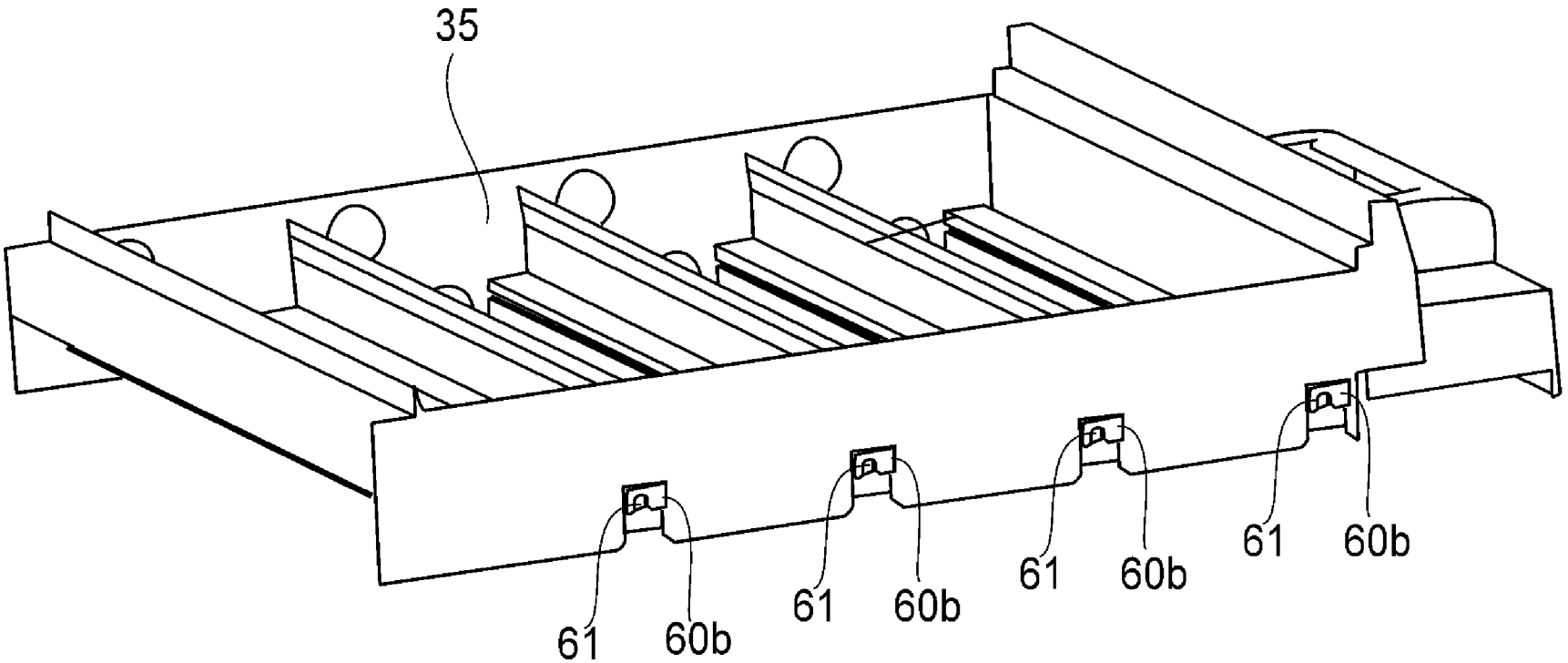
FIG. 10 is a perspective view of the tray, light guides attached to the tray, and projections of the light guides, in the first preferred embodiment.
Figure 11:
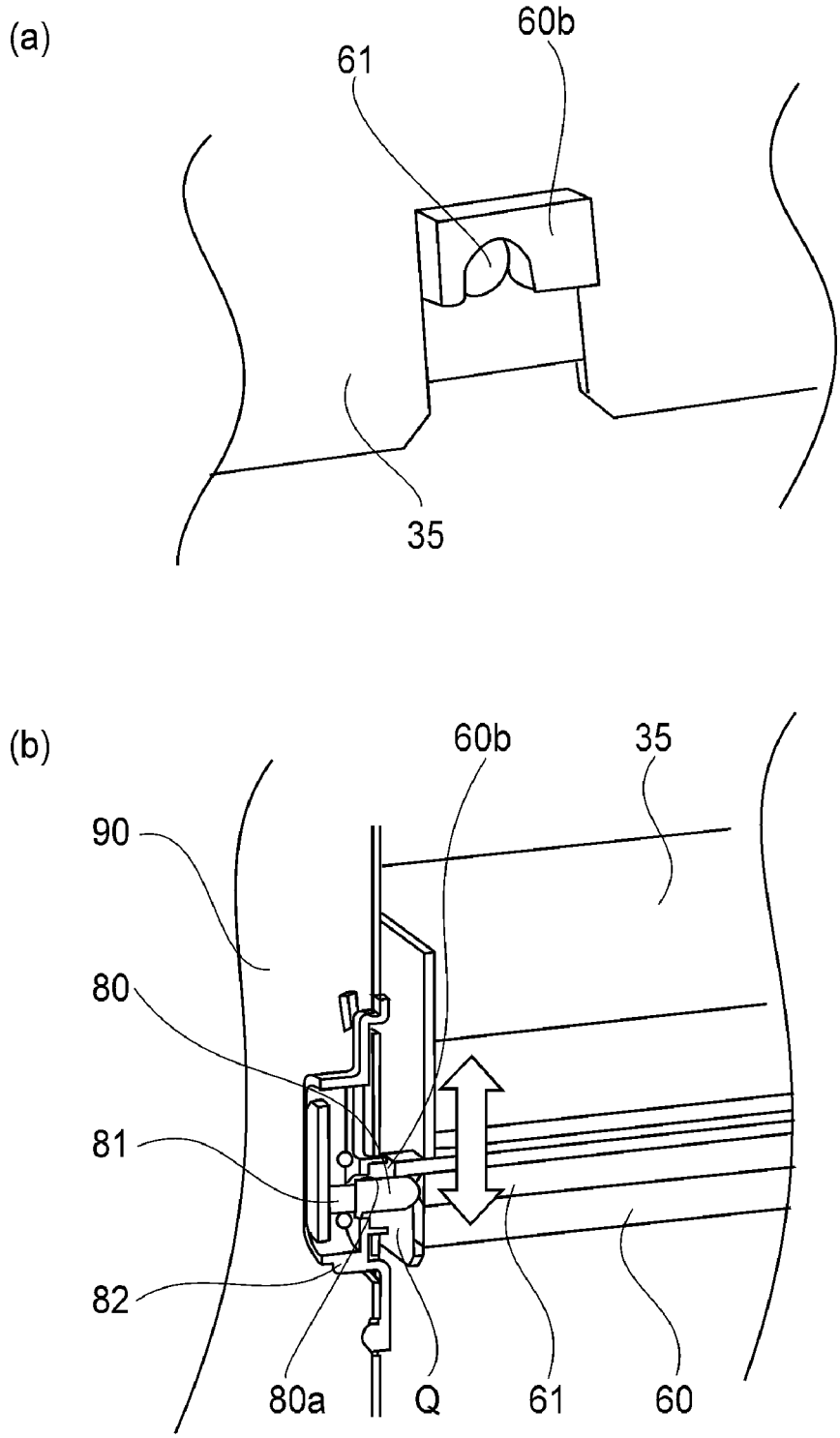
FIG. 11 is an enlarged view (a) of one of the light guides attached to the tray, and the projection of the light guide, and a combination of sectional and perspective views (b) of one of the light guides, and the LED in engagement with the light guide.

Next, the light source positioning member will be concretely described. Referring to FIGS. 10 and 11(*a*), the light source positioning member 60*b* (engaging portions; positioning portion) is a projection which extends outward from one of the lengthwise ends of the housing 60. The end portion 60*b* (engaging portion) is shaped so that its cross-section is in the form of a letter U positioned upside-down. It is the portion of the housing 60, which is placed in contact, with the housing contacting portion 80*a*, which is an integral part of the LED 80, by the movement of the cartridge drawer 35 from its outward position O to its inward position I. It engages with the housing contacting portion 80*a* as it comes into contact with the portion 80*a*, as will be described later. The end portion 60*b* accurately positions the light source 80 in the operational position Q relative to the light guide 61 after the accurate positioning of the cartridge drawer 35 in its inward position O.

Next, referring to FIG. 11(*b*), the LED 80 is supported by an elastic member 81, which is elastically deformable relative to the main assembly frame 90 of the main assembly 100*a;* the LED 80 is enabled to move within its deformation range. As the cartridge drawer 35 is moved from its outward position O to its inward position I, the elastic member 81 is moved by the movement of the cartridge drawer 35, moving thereby the light source 80 into its operational position Q in which the light emitted from the light source 80 enters the light guide 61.

The main assembly 100*a* is structured so that as a user pushes the cartridge drawer 35 into its inward position I, the cartridge drawer 35 moves slightly downward.

Figure 12:
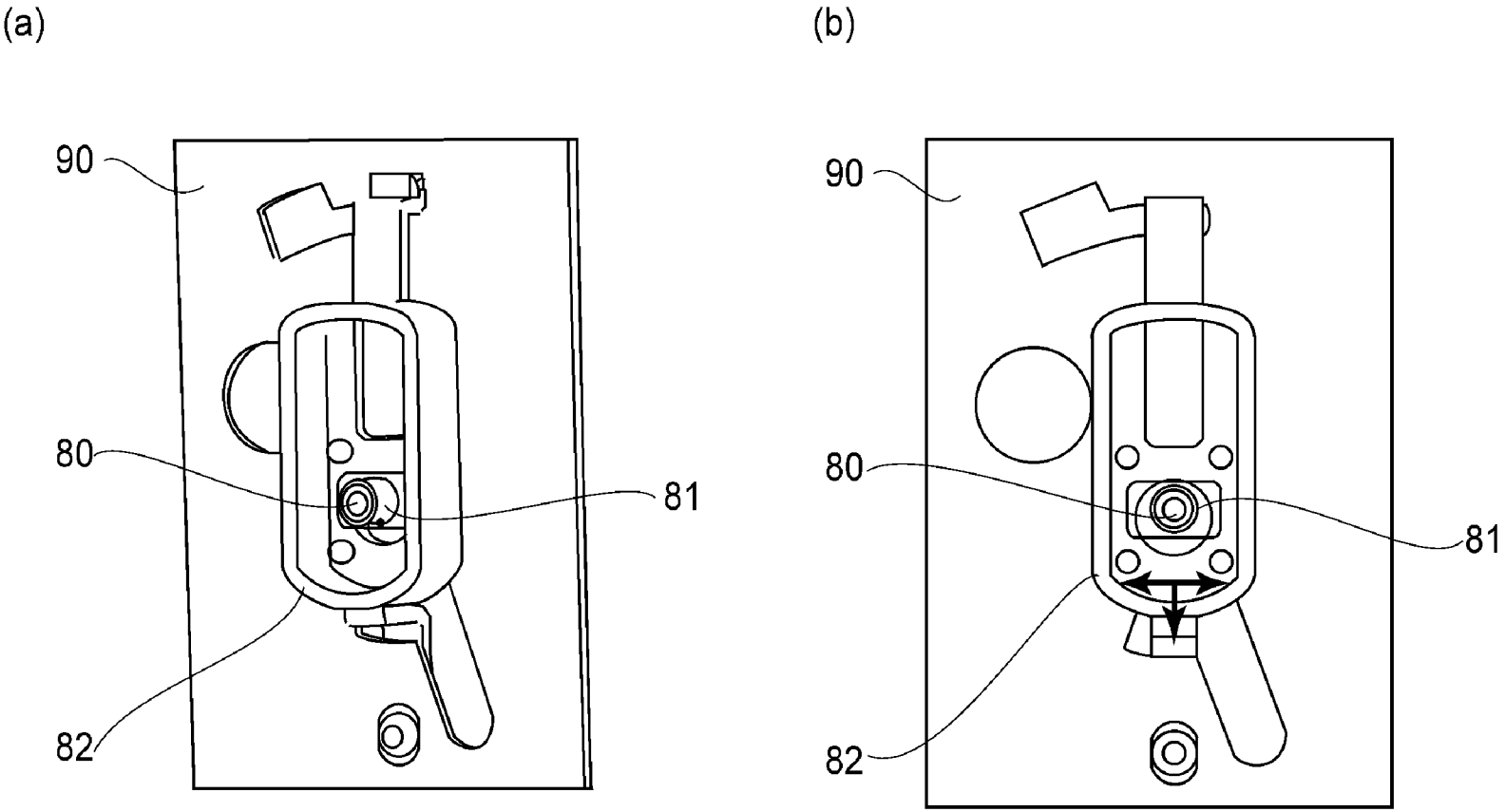
FIG. 12 is plan views of the LED and its adjacencies, before and after the accurate positioning of the LED.

Shown in FIGS. 12(*a*) and 12(*b*) is the LED 80. When the LED 80 is not in engagement with the housing 60, it is in contact with a pre-exposure attachment 82 by its top portion, and remains relatively loosely controlled in position by the elastic member 81.

As the cartridge drawer 35 lowers to its inward position I, the end portion 60*b* (light source positioning member; light source engaging portion) engages with the LED 80, whereby the LED 80 is accurately position by the elastic member 81 after being displaced in the direction indicated by an arrow mark in FIG. 12(*b*) by the resiliency of the elastic member 81. That is, the movement of the cartridge drawer 35 from its outward position O to its inward position I causes the elastic member 81 to move the LED 80 into its operational position Q (FIG. 11) in which the light emitted by the LED 80 enters the light guide 61.

In other words, the LED 80 (light source) is accurately positioned relative to the light guide 61 by the downward movement of the cartridge drawer 35 described above. Therefore, it is ensured that the LED 80 is accurately positioned relative to the light guide 61. After the accurate positioning of the LED 80 relative to the light guide 61, the LED 80 remains pressured in the lengthwise direction of the cartridge P by the resiliency of the elastic member 81. Incidentally, the lengthwise direction of the cartridge P is the same as the lengthwise direction of the drum 1.

The light guide 61 is accurately positioned relative to the combination of the procedures and structural arrangements described above, and the LED 80 is accurately position relative to the light guide 16 also by the combination. Therefore, it is possible to attach the light guide 61 for the pre-exposure, to the main assembly. That is, the present invention can provide an image forming apparatus which is low in the cost of the cartridge P therefor, but, is high in image quality.

Incidentally, in this embodiment, the projection 83*a*, which comes into contact with the frame 5, is provided as a part of the slidingly movable member. However, the frame contacting portion (projection 83*a*) may be provided as a part of the housing 60. In the case where the frame contacting portion (projection 83*a*) is provided as a part of the housing 60, the housing 60 functions as the member which is slidingly movable relative to the cartridge drawer 35, making it therefore unnecessary to provide the main assembly 100*a* with the sliding member 83, and further, the cartridge frame 5 and housing 60 is directly positioned relative to each other. Further, the slidingly movable member 83 and housing 60 may be integrated.

Also in this embodiment, the light guide 61 is accurately positioned relative to the photosensitive drum 1 by placing the projection 83*a* in contact with the frame 5. However, the image forming apparatus 100 may be structured so that the light guide 61 is accurately positioned by the direct contact between the projection 83*a*, and the portion of the peripheral surface of the photosensitive drum 1, which is not used for image formation. This optional structural arrangement accurately positions the light guide 61 relative to the photosensitive drum 1 through the direct contact between the light guide 61 and photosensitive drum 1, making it possible to position the light guide 61 at a higher level of precision than that in this embodiment.

As described above, the light emitted from the light source 80 is projected by the light guide 61 in the direction parallel to the lengthwise direction of the photosensitive drum 1 when the cartridge P is in its image formation position R. Thus, the charge remaining on the photosensitive drum 1 after the transfer of the developer image on the photosensitive drum 1 onto the recording medium S is removed by the light emitted by the light source 80 (by so-called pre-exposure).

Embodiment 2

Figure 13:
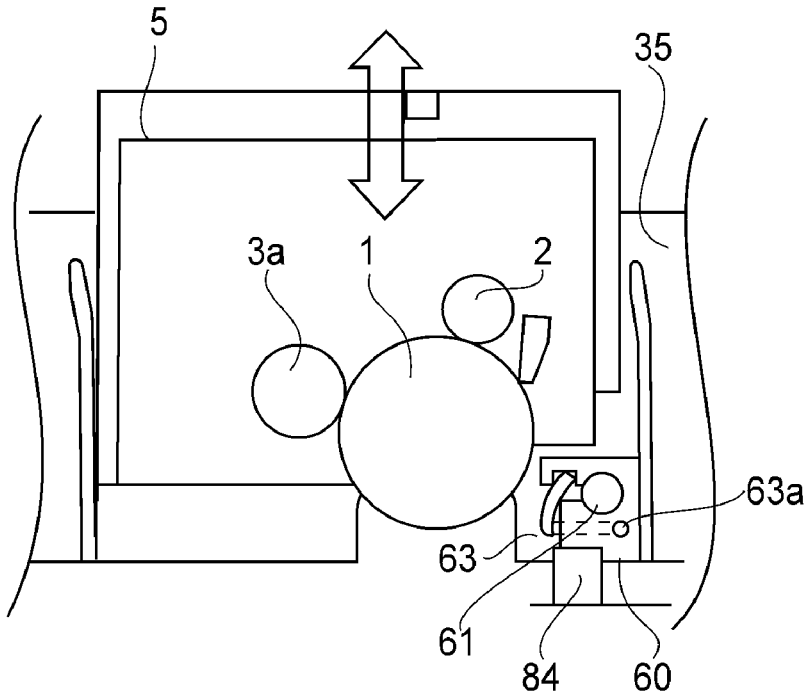
FIG. 13 is a schematic sectional view (a) of the cartridge, cartridge drawer, light guide, light guide housing, shutter, and elastic member, before the completion of the mounting of the cartridge and when the shutter is closed, and (b) is the same as Figure, except that it is after the completion of the mounting of the cartridge and when the shutter is open.
Figure 13:
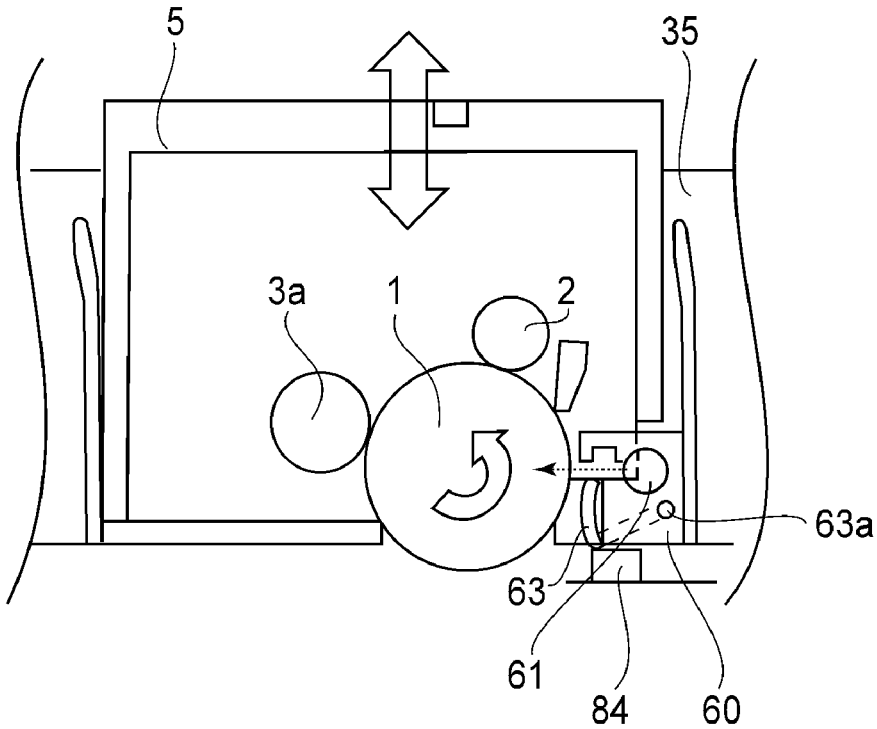

Next, referring to FIGS. 13(*a*) and 13(*b*), the image forming apparatus in the second preferred embodiment of the present invention will be described. By the way, the apparatus in this embodiment is the same in basic structure as that in the preceding embodiment described above. Thus, the descriptions of this embodiment, which are same as, or similar to, those of the preceding embodiment, will not be given; only the structural features of the image forming apparatus in this embodiment, which are different from those in the first embodiment, will be described. Further, the members, portions, etc., in this embodiment, which are the same in function as the counterparts in the first preferred embodiment, will be given the same referential codes as those given to the counterparts in the first preferred embodiment.

In this embodiment, the light guide 61 is provided with a shutter for protecting the light guide 61. More concretely, referring to FIGS. 13(*a*) and 13(*b*), the housing 60 is provided with a shutter 63, which is rotationally movable about a shaft 63*a*. The shutter 63 is a member for covering or exposing the opening with which the housing 60 is provided to allow the light to be projected upon the photosensitive drum 1 from the light guide 61, or to block the light. That is, when the cartridge P is not in the main assembly 100*a*, the shutter 63 covers the portion of the light guide 61, which faces the peripheral surface of the photosensitive drum 1. Further, when the cartridge P is in its image forming position in the main assembly 100*a*, the shutter 63 exposes the portion of the shutter guide 61, which faces the photosensitive drum 1. Here, the shutter 63 shields the portion of the light guide 61, which faces the photosensitive drum 1. When the cartridge P is not in the tray 35, the shutter 63 keeps covered the portion of the light guide 61, which faces the photosensitive drum 1. Further, as the cartridge P is mounted into the tray 35, the shutter 63 exposes the portion of the light guide 61, which faces the photosensitive drum 1.

The shutter 63 is kept upwardly pressured by the resiliency of a spring 84 (elastic member). Therefore, as the cartridge P is mounted into the tray 35, the shutter 63 is opened in the following manner. That is, as the frame 5 is mounted into the cartridge drawer 35, the frame 5 comes into contact with the shutter 63, and pushes down the shutter 63 against the resiliency of the spring 84, whereby the shutter 63 is opened. As the frame 5 is pulled out of the tray 35, the abovementioned force, which is working in the direction to push the shutter 63 downward, is eliminated, allowing the shutter 63 to be moved back into its closed position by the resiliency of the spring 84.

Structuring the image forming apparatus 100 as described above can prevent foreign substances, dusts, etc., from adhering to the light guide 61 when the cartridge P is not in the main assembly 100*a*. Therefore, it can prevent the problem that the photosensitive drum 1 is unevenly pre-exposed because of the presence of the abovementioned foreign substance, dusts, etc., upon the light guide 61.

Further, the shutter 63 in this embodiment may be provided with a cleaning brush or the like, which is attached to the light guide side of the shutter 63, so that the light emitting portion of the light guide 61 is cleaned when the cartridge P is inserted or pulled out.

Embodiment 3

Next, referring to FIGS. 14 and 15, the third preferred embodiment of the present invention will be described.

Figure 14:
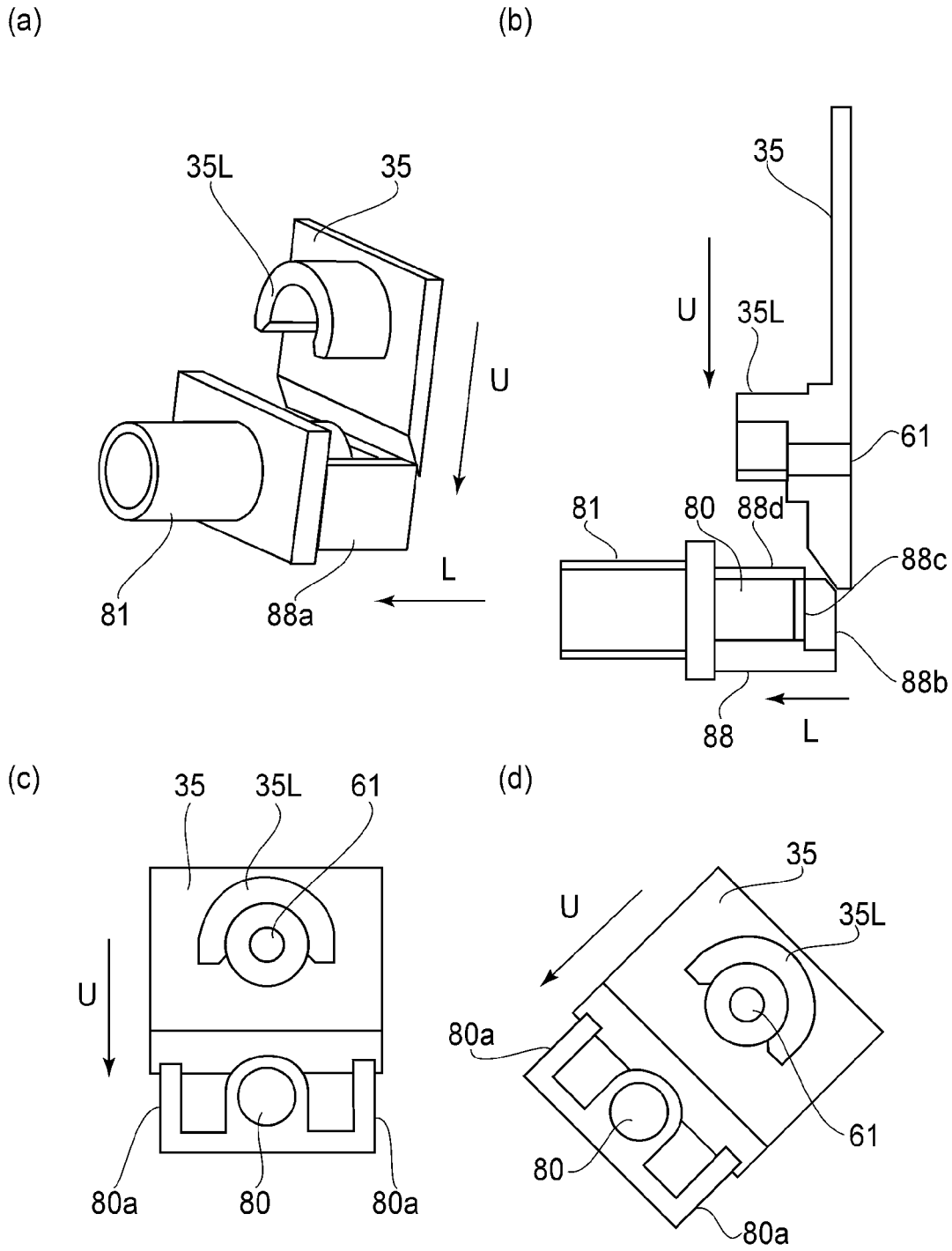
FIG. 14 is a drawing for describing the structural arrangement for accurately positioning the LED.
Figure 15:
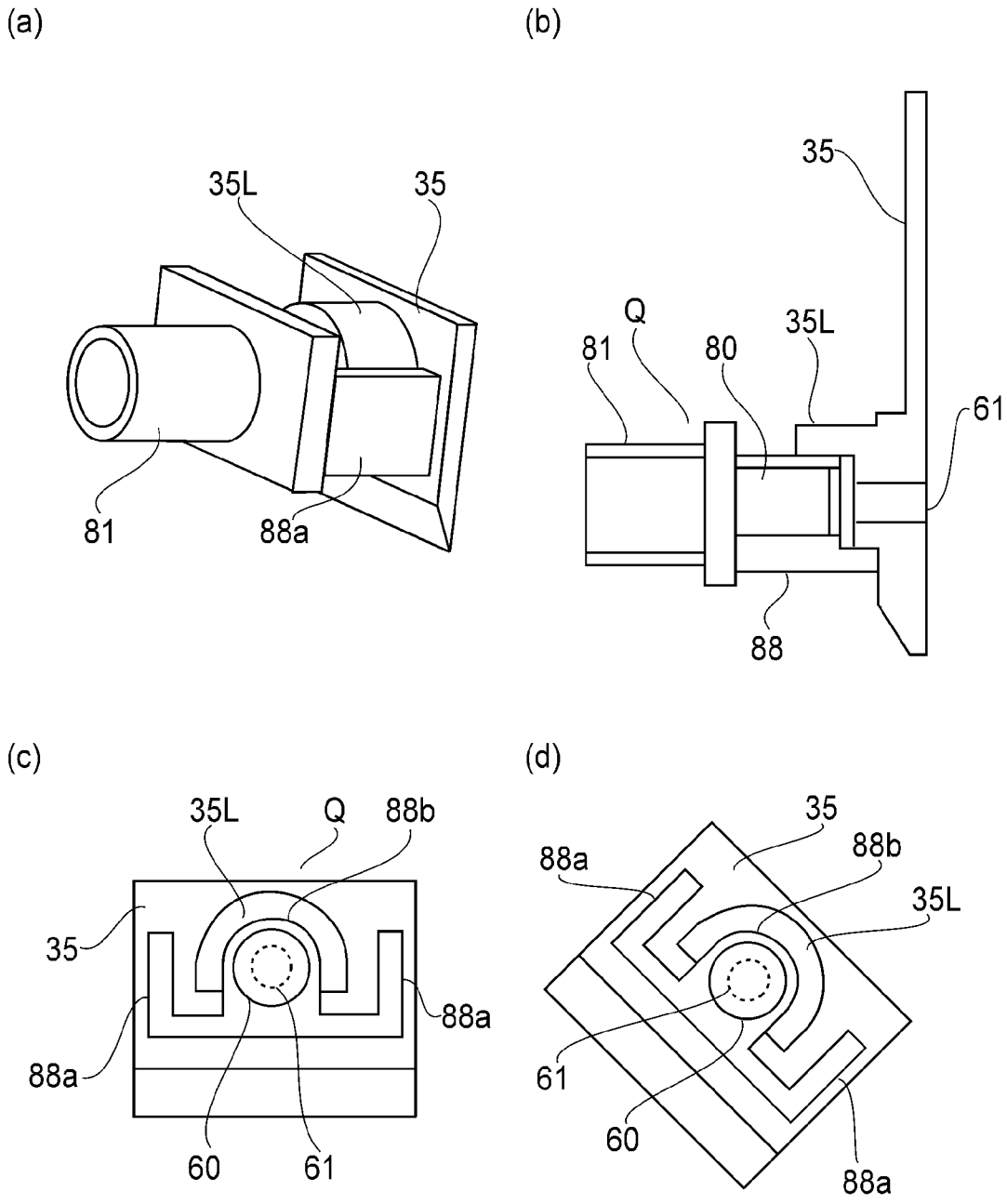
FIG. 15 is also a drawing for describing the structural arrangement for accurately positioning the LED.

FIGS. 14 and 15 are drawings of the portions for accurately positioning the LED 80 and light guide 61 relative to each other. The LED 80 is solidly held by an LED housing 88 (light source supporting member). The housing 88 is disposed so that it is removable by the resiliency of the elastic member 81. Further, it is disposed so that it can move the LED 80 in the direction parallel to the lengthwise direction of the cartridge P in its image formation position, and also, so that it is on the outward side of the cartridge drawer 35 in its inward position. The housing 88 supports the LED 80 as described before. Further, the housing 88 is disposed so that it can move the LED 80 in the direction parallel to the lengthwise direction P in the image formation position, and also, so that it is on the outward side of the tray 35 when the tray 35 is in the inward position I.

The direction in which the cartridge drawer 35 is mounted is as indicated by an arrow mark U (FIG. 14). As the cartridge drawer 35 is moved into its image formation position, the housing 88 is moved by the cartridge drawer 35 in the direction indicated by an arrow mark L, being thereby placed in the position shown in FIG. 15. The cartridge drawer 35 and housing 88 are accurately positioned relative to each other by the contact between the cartridge drawer positioning semi-circular portion 35L (engaging portion; positioning member on supporting member side) of the cartridge drawer 35, and the cartridge drawer positioning arcuate (semi-circular) portion 88*b* (portion to be engaged; positioning portion on housing side) (FIG. 15(*c*)). This contact between the cartridge drawer positioning semi-circular portion 35L and the cartridge positioning arcuate (semi-circular) portion of the housing 88 aligns the optical axis of the LED 80 with that of the light guide 61. Further, a structural arrangement is made to make the arcuate portion 35L overlaps with the vertical walls 88*a* of the housing 88 in order to prevent the light from the LED 80 from leaking. Further, another structural arrangement is made to housing facing surface of the arcuate portion 35L (engaging portion) contacts the housing 88, as shown in FIG. 15(*b*), in order to prevent the light from the LED 80 from leaking. Further, in order to prevent the LED 80 from protruding relative to the housing 80 toward the light guide 61, the LED 80 is disposed so that the light guide side of the LED 80 is recessed from the housing 80. Thus, should the LED 80 rub against the cartridge drawer 35, the light emitting surface of the LED 80 is not damaged. Similarly, in terms of the vertical direction of the apparatus, the LED protecting portion 88*c* of the housing 88 is recessed from the light guide accommodating (sliding) surface 88*b* of the housing 88, preventing thereby the light guide 61 and housing 88 from rubbing against each other; the light receiving portion of the light guide 61 is prevented from being damaged by the housing 88. Although not illustrated, in order to prevent the light receiving portion of the light guide 61 from being damaged, the light guiding surface may be recessed from the cartridge drawer surface.

In this embodiment, in order to afford relaxing the accuracy with which the LED 80 (light source) and light guide 61 (light guiding member) are to be positioned relative to each other, the external diameter of the light emitting surface of the LED 80 is made larger than the external diameter of the light guide 61. That is, the amount of light necessary to completely remove electric charge from the photosensitive drum 1 is secured by making the light catching surface of the light guide 61 fall within the light emitting surface of the LED 80 in terms of their radial direction.

Provision of the above-described structural features ensures that the optical axis of the LED 80 aligns with that of the light guide 61, and also, that the light from the LED 80 does not leak. Therefore, the provision ensures that excellent images can be obtained by the image forming apparatus in this embodiment.

Incidentally, in this embodiment, the direction in which the cartridge drawer 35 is mounted is vertical. However, the direction in which the cartridge drawer 35 is mounted may be made slanted relative to the vertical direction, as shown in FIGS. 14(*d*) and 15(*d*), and such a modification can provide the same results as those obtained by this embodiment.

In this embodiment, the elastic member 81 is a part of the main assembly 100*a*. It keeps the light source 80 pressured by its elasticity in the direction parallel to the lengthwise direction of the cartridge P. As the cartridge drawer 35 is moved from its outward position O to its inward position I, the elastic member 81 moves with the cartridge drawer 35, and the end portion 60*b* (engaging portions in first and second preferred embodiments) and arcuate portion 35L (engaging portion in third preferred embodiment), with which the cartridge drawer 35 is provided, come into contact with the cartridge drawer engaging portion (portion 80*a* in first and second preferred embodiments; and arcuate portion 88*d* in third preferred embodiment), and the end portion 60*b* or arcuate portion 35L moves the light source 80 into its operational position Q against the resiliency of the elastic member 81.

Embodiment 4

Next, referring to FIGS. 16 and 17, the fourth preferred embodiment of the present invention will be described.

Figure 16:
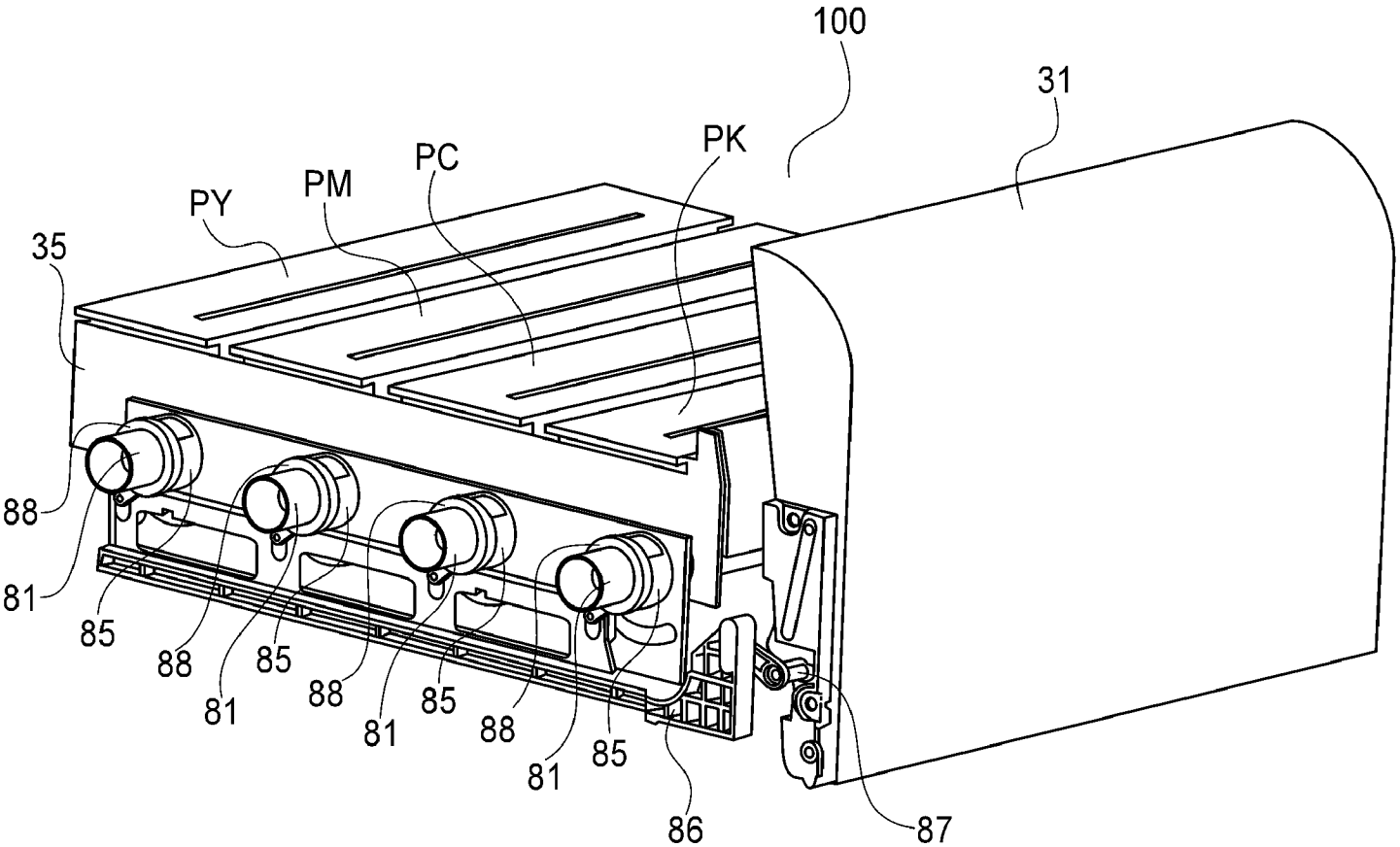
FIG. 16 is a perspective view of the image forming apparatus in the fourth embodiment of the present invention, with the door closed.
Figure 17:
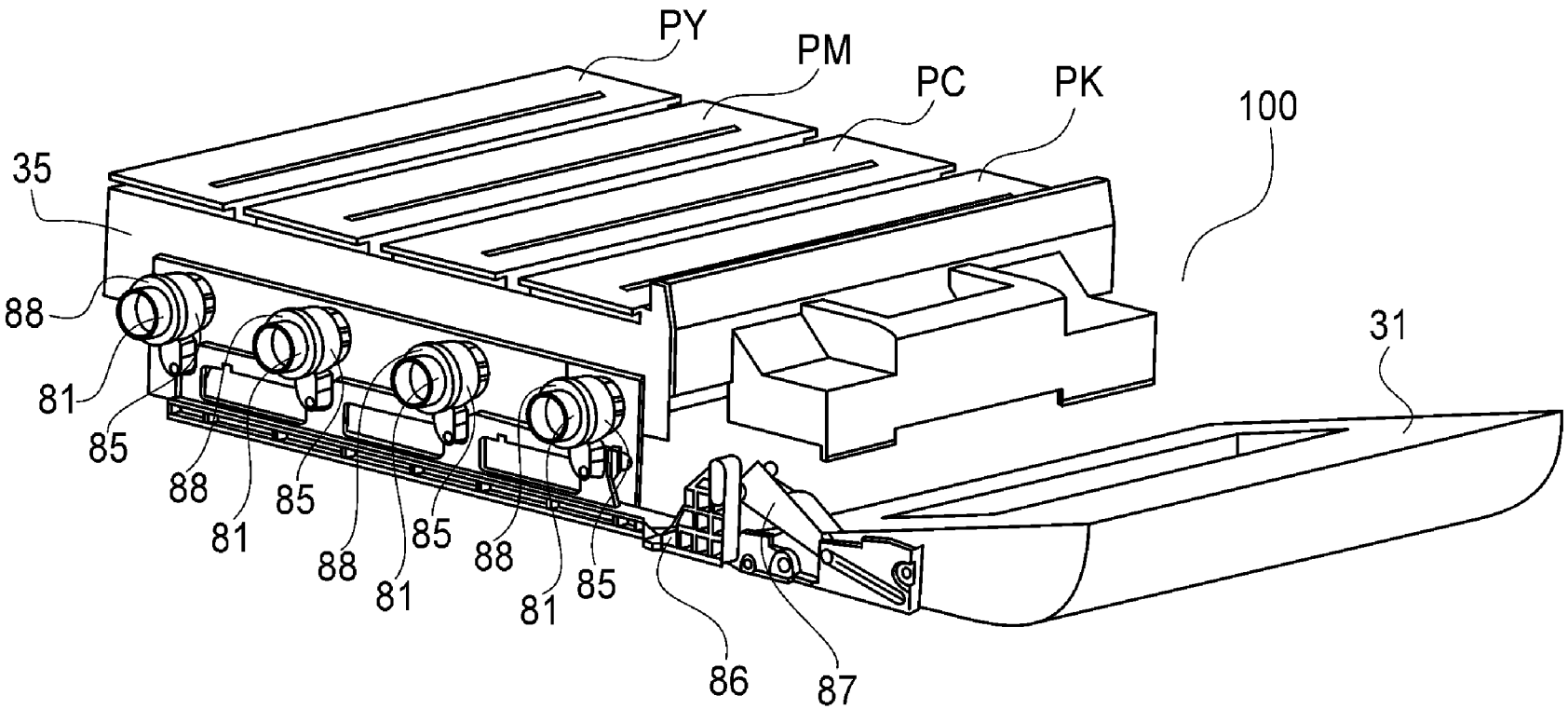
FIG. 17 is a perspective view of the image forming apparatus in the fourth embodiment, with its door open.

FIGS. 16 and 17 are perspective views of the mechanism for causing the LED unit to be moved by the movement of the door 31. The door 31 is in connection with one end of a door linkage 87, whereas the other end of the door linkage 87 is in connection with an LED lever 86. The opening or closing movement of the door 31 causes the lever 86 to move frontward or rearward, respectively, of the image forming apparatus. This movement of the lever 86 causes a cam 85 to rotationally move, causing thereby the housing 88 to move inward or outward of the cartridge drawer 35.

FIG. 16 shows the image forming apparatus when the door 31 of the apparatus is its closed position. FIG. 17 shows the image forming apparatus when the door 31 of the apparatus is open, and the housing 88 has moved leftward of the apparatus.

Next, referring to FIGS. 18(*a*) and 18(*b*), the LED 80 and light guide 61 in this embodiment will be described.

Figure 18:
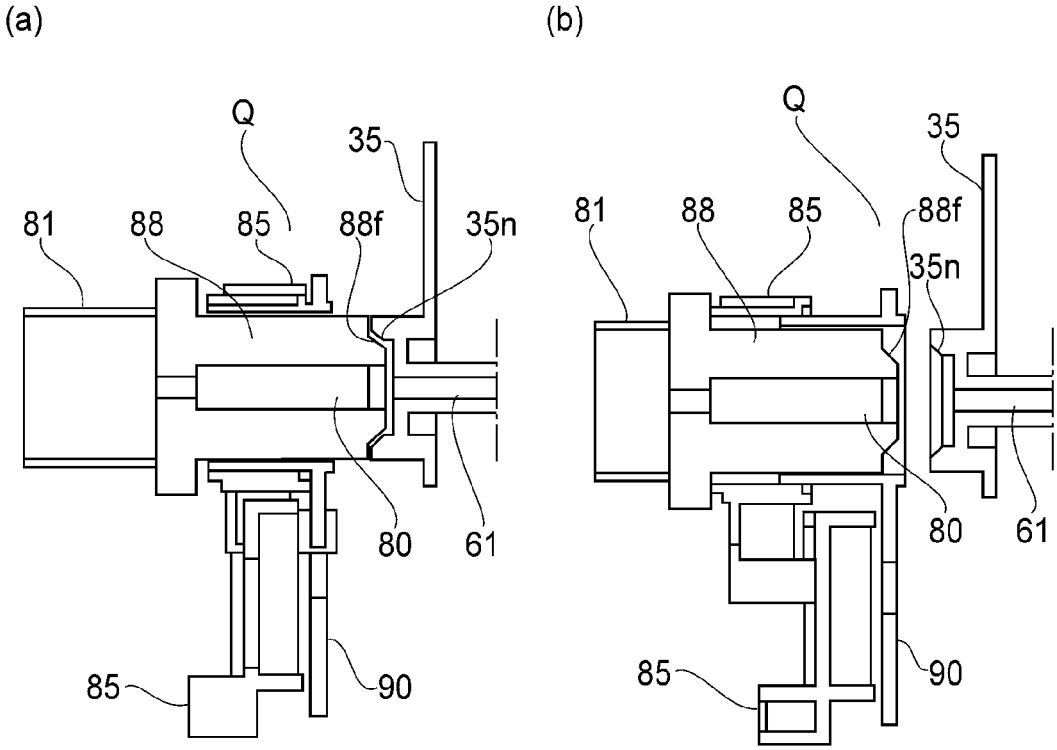
FIG. 18 is a drawing for describing the structural arrangement for accurately position the LED.

FIG. 18(*a*) shows the image forming apparatus 100 when the housing 88 is in contact with the cartridge drawer 35, that is, when the door 31 is closed. The housing 88 is remaining in contact with the cartridge drawer 35 because of the presence of the elasticity of the elastic member 81 which keeps the housing 88 pressured toward the cartridge drawer 35.

FIG. 18(*b*) shows the image forming apparatus 100 when the housing 88 is in its left end of its moving range relative to the image forming apparatus 100, that is, when the door 31 is open. As the door 31 is opened, the cam 85 is moved leftward of the image forming apparatus 100 by the movement of the door 31, causing the cam 85 to come into contact with the housing 88 and move leftward of the image forming apparatus 100 with the housing 88. Thus, the housing 88 is separated from the cartridge drawer 35.

On the other hand, as the door 31 is closed, the movement of the door 31 causes the cam 85 to move toward the cartridge drawer 35. The housing 88 comes into contact with the cartridge drawer 35, and stops. After the stopping of the housing 88, the cam 85 moves further toward the cartridge drawer 35, and separates from the housing 88 (FIG. 18(*a*)).

The tapered portion 35*n* (positioning portion, positioning portion on supporting member side, positioning member on light guiding member side) of the cartridge drawer 35 comes into contact with the tapered portion 88*f* (positioning portion on housing side, positioning portion on light source side) (FIG. 18(*a*)), whereby the cartridge drawer 35 and housing 88 are accurately positioned relative to each other. As a result, the optical axis of the LED 80 aligns with that of the light guide 61. Further, the image forming apparatus 100 is structured so that the positioning portion of the cartridge drawer 35 overlaps with the housing 88, and also, contacts the housing 88, to prevent the light from the LED from leaking. Further, in this embodiment, the light emitting surface of the LED 80 is made larger in external diameter than the light guide 61 to afford relaxing the requirement regarding positioning accuracy of the LED 80 and light guide 61 relative to each other.

In the fourth embodiment of the present invention described above, the main assembly 100*a* is provided with the hole 30 through which the tray 35 is moved between its outward position O and its inward position I. Further, the main assembly 100*a* is provided with the door 31 for exposing or covering the hole 30. The door 31 is enabled to take the position in which it keeps the hole 30 covered, and the position in which it keeps the hole 30 exposed. As the door 31 is moved from its open position to its closed position, the cam 85 is moved by the movement of the door 31, moving thereby the light source 80 into the operational position of the light source 80, in which the light emitted from the light source 80 enters the light guide 61. Further, the tray 35 is provided with a tapered portion 35*n* for accurately position the light source 80 relative to the light guide 61, with which the tray 31 is provided, after the accurate positioning of the tray 35 in its inward position I. Therefore, as the door 31 is moved from its open position to its closed position, the light source 80 and light guide 61 are accurately positioned relative to each other by the movement of the door 31.

The employment of the above described structural features of the image forming apparatus ensures that the optical axis of the LED 80 satisfactorily aligns with that of the light guide 61, and also, it prevents the light leakage, making it possible to obtain excellent images.

The embodiments of the present invention described above made it possible to improve an image forming apparatus in terms of the level of accuracy with which the light guide 61 and LED 80 (light source) are positioned relative to each other, even though the light guide 61 (light guiding member) was attached to the movable cartridge drawer 35 (cartridge supporting member).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 249589/2008 filed Sep. 29, 2008, 189701/2009 filed Aug. 19, 2009, and 205488/2009 filed Sep. 7, 2009, which are hereby incorporated by reference.

What is claimed is:

1. An electrophotographic image forming apparatus for forming an image on a recording material in the state that a cartridge is detachably mounted to a main assembly of said electrophotographic image forming apparatus, said electrophotographic image forming apparatus comprising:

a cartridge supporting member movable between an inside position in said main assembly of the apparatus and an outside position which is outside said main assembly of the apparatus and in which the cartridge is mountable and the mountable, in the state that the cartridge is detachably mounted thereon;

a light source for emitting light;

a light guide member, provided on said cartridge supporting member, for guiding the light emitted from said light source along a longitudinal direction of an electrophotographic photosensitive drum to electrically discharge charge remaining on said electrophotographic photosensitive drum after a developed image formed on said electrophotographic photosensitive drum is transferred onto the recording material in the state that the cartridge is in an image forming position, which is the inside position, for forming the image on the recording material;

an interrelating member for moving said light source to an operating position where the light emitted from said light source enters said light guide member in interrelation with movement of said cartridge supporting member from the outside position to the inside position; and a positioning member for positioning said light source at the operating position relative to said light guide member provided on said cartridge supporting member positioned in the inside position.

2. An apparatus according to claim 1, wherein said interrelating member includes an elastic member provided in said main assembly of the apparatus, said light source is elastically urged by an elastic force of said elastic member in a longitudinal direction of the cartridge, and wherein in interrelation with the movement of said cartridge supporting member from the outside position to the inside position, an engaging portion provided on said cartridge supporting member is contacted to a portion-to-be-engaged provided integral with said light source to move said light source to the operating position against the elastic force.

3. An apparatus according to claim 1 or 2, further comprising a light source supporting member for supporting said light source, wherein said light source supporting member is capable of moving said light source in the longitudinal direction of the cartridge positioned in the image forming position and is positioned outside said cartridge supporting member which is in the inside position.

4. An apparatus according to claim 1 or 2, wherein said light guide member is mounted to a slidable member movably provided on said cartridge supporting member, and said slidable member includes a contact portion for contacting said process cartridge supported by said cartridge supporting member, and wherein said contact portion includes an elastic member for urging said contact portion toward the cartridge.

5. An apparatus according to claim 4, wherein said light guide member including a shutter member for blocking a portion opposing to said electrophotographic photosensitive drum.

6. An apparatus according to claim 5, wherein said shutter member blocks the portion opposing to said photosensitive drum when the cartridge is not mounted to said cartridge supporting member, and said shutter member exposes the position on said light guide member opposing to said electrophotographic photosensitive drum when the cartridge is mounted to said cartridge supporting member.

7. An electrophotographic image forming apparatus for forming an image on a recording material in the state that a cartridge is detachably mounted to a main assembly of said electrophotographic image forming apparatus, said electrophotographic image forming apparatus comprising:

a cartridge supporting member movable between an inside position in said main assembly of the apparatus and an outside position which is outside said main assembly of the apparatus and in which the cartridge is mountable and the mountable, in the state that the cartridge is detachably mounted thereon;

a light source for emitting light;

a light source supporting member for supporting said light source, wherein said light source supporting member is capable of moving said light source in the longitudinal direction of the cartridge positioned in an image forming position for forming the image on the recording material and is positioned outside said cartridge supporting member which is in the inside position;

a light guide member, provided on said cartridge supporting member, for guiding the light emitted from said light source along a longitudinal direction of an electrophotographic photosensitive drum to electrically discharge charge remaining on said electrophotographic photosensitive drum after a developed image formed on said electrophotographic photosensitive drum is transferred onto the recording material in the state that the cartridge is in the image forming position;

an opening through which said cartridge supporting member passes when it moves between the outside position and the inside position;

an openable member movable between a closing position for closing said opening and an opening position for opening said opening;

an interrelating member for moving said light source to an operating position where the light emitted from said light source enters said light guide member, in interrelation with the movement of said openable member from the opening position to the closing position; and a positioning portion for positioning said light source at the operating position relative to said light guide member provided on said cartridge supporting member positioned at the inside position.

* * * * *